US009185487B2

(12) United States Patent
Solbach et al.

(10) Patent No.: US 9,185,487 B2
(45) Date of Patent: Nov. 10, 2015

(54) SYSTEM AND METHOD FOR PROVIDING NOISE SUPPRESSION UTILIZING NULL PROCESSING NOISE SUBTRACTION

(75) Inventors: Ludger Solbach, Mountain View, CA (US); Carlo Murgia, Mountain View, CA (US)

(73) Assignee: Audience, Inc., Mountain View, CA (US)

( * ) Notice: Subject to any disclaimer, the term of this patent is extended or adjusted under 35 U.S.C. 154(b) by 1497 days.

(21) Appl. No.: 12/215,980

(22) Filed: Jun. 30, 2008

(65) Prior Publication Data

US 2009/0323982 A1 Dec. 31, 2009

(51) Int. Cl.
*H04R 3/00* (2006.01)

(52) U.S. Cl.
CPC ..... *H04R 3/005* (2013.01); *H04R 2410/01* (2013.01)

(58) Field of Classification Search
CPC . G10L 21/0208; G10L 21/0216; G10L 21/02; G10L 21/0364; G10L 2021/02165; G10L 2021/02166; G10L 2021/02161; G10L 2021/02087; G10L 2010/0208; G10L 2025/783; G10L 2025/786; H04R 3/005; H04R 1/406; H04R 2430/25; H04R 2410/05; H04R 2410/01; H04R 2430/23; H04R 25/407
USPC ..... 381/94.7, 92, 94.2, 98
See application file for complete search history.

(56) References Cited

U.S. PATENT DOCUMENTS 3,976,863 A 8/1976 Engel
3,978,287 A 8/1976 Fletcher et al.
4,137,510 A 1/1979 Iwahara
4,433,604 A 2/1984 Ott
4,516,259 A 5/1985 Yato et al.
4,535,473 A 8/1985 Sakata
4,536,844 A 8/1985 Lyon
4,581,758 A 4/1986 Coker et al.

(Continued)

FOREIGN PATENT DOCUMENTS

JP 62110349 5/1987
JP 04184400 7/1992

(Continued)

OTHER PUBLICATIONS

Boll, Steven F. "Suppression of Acoustic Noise in Speech using Spectral Subtraction", IEEE Transactions on Acoustics, Speech and Signal Processing, vol. ASSP-27, No. 2, Apr. 1979, pp. 113-120.

(Continued)

*Primary Examiner* — Ping Lee
(74) *Attorney, Agent, or Firm* — Carr & Ferrell LLP

(57) ABSTRACT

Systems and methods for noise suppression using noise subtraction processing are provided. The noise subtraction processing comprises receiving at least a primary and a secondary acoustic signal. A desired signal component may be calculated and subtracted from the secondary acoustic signal to obtain a noise component signal. A determination may be made of a reference energy ratio and a prediction energy ratio. A determination may be made as to whether to adjust the noise component signal based partially on the reference energy ratio and partially on the prediction energy ratio. The noise component signal may be adjusted or frozen based on the determination. The noise component signal may then be removed from the primary acoustic signal to generate a noise subtracted signal which may be outputted.

20 Claims, 9 Drawing Sheets

(56) References Cited

U.S. PATENT DOCUMENTS 4,628,529 A 12/1986 Borth et al.
4,630,304 A 12/1986 Borth et al.
4,649,505 A 3/1987 Zinser, Jr. et al.
4,658,426 A 4/1987 Chabries et al.
4,674,125 A 6/1987 Carlson et al.
4,718,104 A 1/1988 Anderson
4,811,404 A 3/1989 Vilmur et al.
4,812,996 A 3/1989 Stubbs
4,864,620 A 9/1989 Bialick
4,920,508 A 4/1990 Yassaie et al.
5,027,410 A 6/1991 Williamson et al.
5,054,085 A 10/1991 Meisel et al.
5,058,419 A 10/1991 Nordstrom et al.
5,099,738 A 3/1992 Hotz
5,119,711 A 6/1992 Bell et al.
5,142,961 A 9/1992 Paroutaud
5,150,413 A 9/1992 Nakatani et al.
5,175,769 A 12/1992 Hejna, Jr. et al.
5,187,776 A 2/1993 Yanker
5,208,864 A 5/1993 Kaneda
5,210,366 A 5/1993 Sykes, Jr.
5,224,170 A 6/1993 Waite, Jr.
5,230,022 A 7/1993 Sakata
5,319,736 A 6/1994 Hunt
5,323,459 A 6/1994 Hirano
5,341,432 A 8/1994 Suzuki et al.
5,371,800 A 12/1994 Komatsu et al.
5,381,473 A 1/1995 Andrea et al.
5,381,512 A 1/1995 Holton et al.
5,400,409 A 3/1995 Linhard
5,402,493 A 3/1995 Goldstein
5,402,496 A 3/1995 Soli et al.
5,471,195 A 11/1995 Rickman
5,473,702 A 12/1995 Yoshida et al.
5,473,759 A 12/1995 Slaney et al.
5,479,564 A 12/1995 Vogten et al.
5,502,663 A 3/1996 Lyon
5,544,250 A 8/1996 Urbanski
5,574,824 A 11/1996 Slyh et al.
5,583,784 A 12/1996 Kapust et al.
5,587,998 A 12/1996 Velardo, Jr. et al.
5,590,241 A 12/1996 Park et al.
5,602,962 A 2/1997 Kellermann
5,675,778 A 10/1997 Jones
5,682,463 A 10/1997 Allen et al.
5,694,474 A 12/1997 Ngo et al.
5,706,395 A 1/1998 Arslan et al.
5,717,829 A 2/1998 Takagi
5,729,612 A 3/1998 Abel et al.
5,732,189 A 3/1998 Johnston et al.
5,749,064 A 5/1998 Pawate et al.
5,757,937 A 5/1998 Itoh et al.
5,774,837 A 6/1998 Yeldener et al.
5,792,971 A 8/1998 Timis et al.
5,796,819 A 8/1998 Romesburg
5,806,025 A 9/1998 Vis et al.
5,809,463 A 9/1998 Gupta et al.
5,819,215 A 10/1998 Dobson et al.
5,825,320 A 10/1998 Miyamori et al.
5,839,101 A 11/1998 Vahatalo et al.
5,920,840 A 7/1999 Satyamurti et al.
5,933,495 A 8/1999 Oh
5,943,429 A 8/1999 Handel
5,956,674 A 9/1999 Smyth et al.
5,974,380 A 10/1999 Smyth et al.
5,978,824 A * 11/1999 Ikeda ..... 708/322
5,983,139 A 11/1999 Zierhofer
5,990,405 A 11/1999 Auten et al.
6,002,776 A 12/1999 Bhadkamkar et al.
6,061,456 A 5/2000 Andrea et al.
6,072,881 A 6/2000 Linder
6,097,820 A 8/2000 Turner
6,108,626 A 8/2000 Cellario et al.
6,122,610 A 9/2000 Isabelle
6,134,524 A 10/2000 Peters et al.
6,137,349 A 10/2000 Menkhoff et al.
6,140,809 A 10/2000 Doi
6,173,255 B1 1/2001 Wilson et al.
6,180,273 B1 1/2001 Okamoto
6,205,421 B1 3/2001 Morii
6,216,103 B1 4/2001 Wu et al.
6,222,927 B1 4/2001 Feng et al.
6,223,090 B1 4/2001 Brungart
6,226,616 B1 5/2001 You et al.
6,263,307 B1 7/2001 Arslan et al.
6,266,633 B1 7/2001 Higgins et al.
6,317,501 B1 11/2001 Matsuo
6,339,758 B1 * 1/2002 Kanazawa et al. ..... 381/94.7
6,355,869 B1 3/2002 Mitton
6,363,345 B1 3/2002 Marash et al.
6,381,570 B2 4/2002 Li et al.
6,430,295 B1 8/2002 Handel et al.
6,434,417 B1 8/2002 Lovett
6,449,586 B1 * 9/2002 Hoshuyama ..... 381/92
6,469,732 B1 10/2002 Chang et al.
6,487,257 B1 11/2002 Gustafsson et al.
6,496,795 B1 12/2002 Malvar
6,513,004 B1 1/2003 Rigazio et al.
6,516,066 B2 2/2003 Hayashi
6,529,606 B1 3/2003 Jackson, Jr. II et al.
6,549,630 B1 4/2003 Bobisuthi
6,584,203 B2 6/2003 Elko et al.
6,622,030 B1 9/2003 Romesburg et al.
6,717,991 B1 4/2004 Gustafsson et al.
6,718,309 B1 4/2004 Selly
6,738,482 B1 5/2004 Jaber
6,760,450 B2 7/2004 Matsuo
6,785,381 B2 8/2004 Gartner et al.
6,792,118 B2 9/2004 Watts
6,795,558 B2 9/2004 Matsuo
6,798,886 B1 9/2004 Smith et al.
6,810,273 B1 10/2004 Mattila et al.
6,882,736 B2 4/2005 Dickel et al.
6,915,264 B2 7/2005 Baumgarte
6,917,688 B2 7/2005 Yu et al.
6,944,510 B1 9/2005 Ballesty et al.
6,978,159 B2 12/2005 Feng et al.
6,982,377 B2 1/2006 Sakurai et al.
6,999,582 B1 2/2006 Popovic et al.
7,016,507 B1 3/2006 Brennan
7,020,605 B2 3/2006 Gao
RE39,080 E 4/2006 Johnston
7,031,478 B2 4/2006 Belt et al.
7,054,452 B2 5/2006 Ukita
7,058,572 B1 6/2006 Nemer
7,065,485 B1 6/2006 Chong-White et al.
7,065,486 B1 6/2006 Thyssen
7,076,315 B1 7/2006 Watts
7,092,529 B2 8/2006 Yu et al.
7,092,882 B2 8/2006 Arrowood et al.
7,099,821 B2 8/2006 Visser et al.
7,142,677 B2 11/2006 Gonopolskiy et al.
7,146,013 B1 * 12/2006 Saito et al. ..... 381/92
7,146,316 B2 12/2006 Alves
7,155,019 B2 12/2006 Hou
7,164,620 B2 1/2007 Hoshuyama
7,171,008 B2 1/2007 Elko
7,171,246 B2 1/2007 Mattila et al.
7,174,022 B1 2/2007 Zhang et al.
7,206,418 B2 4/2007 Yang et al.
7,209,567 B1 4/2007 Kozel et al.
7,225,001 B1 5/2007 Eriksson et al.
7,242,762 B2 7/2007 He et al.
7,246,058 B2 7/2007 Burnett
7,254,242 B2 8/2007 Ise et al.
7,254,535 B2 8/2007 Kushner et al.
7,359,520 B2 * 4/2008 Brennan et al. ..... 381/92
7,412,379 B2 8/2008 Taori et al.
7,433,907 B2 10/2008 Nagai et al.
7,516,067 B2 4/2009 Seltzer et al.
7,555,434 B2 6/2009 Nomura et al.
7,574,352 B2 8/2009 Quatieri, Jr.
7,925,502 B2 4/2011 Droppo et al.
7,949,522 B2 5/2011 Hetherington et al.

(56) References Cited

U.S. PATENT DOCUMENTS

| | | | | |
|---|---|---|---|---|
| 8,175,291 | B2 | 5/2012 | Chan et al. | |
| 8,213,597 | B2 | 7/2012 | Hjelm | |
| 8,705,759 | B2 | 4/2014 | Wolff et al. | |
| 8,718,290 | B2 | 5/2014 | Murgia et al. | |
| 8,744,844 | B2 | 6/2014 | Klein | |
| 8,774,423 | B1 | 7/2014 | Solbach | |
| 2001/0016020 | A1 | 8/2001 | Gustafsson et al. | |
| 2001/0031053 | A1 | 10/2001 | Feng et al. | |
| 2002/0002455 | A1 | 1/2002 | Accardi et al. | |
| 2002/0009203 | A1 | 1/2002 | Erten | |
| 2002/0041693 | A1 | 4/2002 | Matsuo | |
| 2002/0080980 | A1 | 6/2002 | Matsuo | |
| 2002/0106092 | A1 | 8/2002 | Matsuo | |
| 2002/0116187 | A1 | 8/2002 | Erten | |
| 2002/0133334 | A1 | 9/2002 | Coorman et al. | |
| 2002/0147595 | A1 | 10/2002 | Baumgarte | |
| 2002/0184013 | A1 | 12/2002 | Walker | |
| 2003/0014248 | A1 | 1/2003 | Vetter | |
| 2003/0026437 | A1 | 2/2003 | Janse et al. | |
| 2003/0033140 | A1 | 2/2003 | Taori et al. | |
| 2003/0039369 | A1 | 2/2003 | Bullen | |
| 2003/0040908 | A1 | 2/2003 | Yang et al. | |
| 2003/0061032 | A1 | 3/2003 | Gonopolskiy | |
| 2003/0063759 | A1 | 4/2003 | Brennan et al. | |
| 2003/0072382 | A1 | 4/2003 | Raleigh et al. | |
| 2003/0072460 | A1 | 4/2003 | Gonopolskiy et al. | |
| 2003/0095667 | A1 | 5/2003 | Watts | |
| 2003/0099345 | A1 | 5/2003 | Gartner et al. | |
| 2003/0101048 | A1* | 5/2003 | Liu | 704/208 |
| 2003/0103632 | A1 | 6/2003 | Goubran et al. | |
| 2003/0128851 | A1 | 7/2003 | Furuta | |
| 2003/0138116 | A1 | 7/2003 | Jones et al. | |
| 2003/0147538 | A1 | 8/2003 | Elko | |
| 2003/0169891 | A1* | 9/2003 | Ryan et al. | 381/92 |
| 2003/0228023 | A1 | 12/2003 | Burnett et al. | |
| 2004/0013276 | A1 | 1/2004 | Ellis et al. | |
| 2004/0047464 | A1 | 3/2004 | Yu et al. | |
| 2004/0057574 | A1 | 3/2004 | Faller | |
| 2004/0078199 | A1 | 4/2004 | Kremer et al. | |
| 2004/0102967 | A1 | 5/2004 | Furuta et al. | |
| 2004/0131178 | A1 | 7/2004 | Shahaf et al. | |
| 2004/0133421 | A1 | 7/2004 | Burnett et al. | |
| 2004/0165736 | A1 | 8/2004 | Hetherington et al. | |
| 2004/0196989 | A1 | 10/2004 | Friedman et al. | |
| 2004/0263636 | A1 | 12/2004 | Cutler et al. | |
| 2005/0025263 | A1 | 2/2005 | Wu | |
| 2005/0027520 | A1 | 2/2005 | Mattila et al. | |
| 2005/0049864 | A1 | 3/2005 | Kaltenmeier et al. | |
| 2005/0060142 | A1 | 3/2005 | Visser et al. | |
| 2005/0114123 | A1 | 5/2005 | Lukac et al. | |
| 2005/0152559 | A1 | 7/2005 | Gierl et al. | |
| 2005/0152563 | A1* | 7/2005 | Amada et al. | 381/94.7 |
| 2005/0185813 | A1 | 8/2005 | Sinclair et al. | |
| 2005/0213778 | A1 | 9/2005 | Buck et al. | |
| 2005/0216259 | A1 | 9/2005 | Watts | |
| 2005/0228518 | A1 | 10/2005 | Watts | |
| 2005/0240399 | A1 | 10/2005 | Makinen | |
| 2005/0276423 | A1 | 12/2005 | Aubauer et al. | |
| 2005/0278171 | A1 | 12/2005 | Suppappola et al. | |
| 2005/0288923 | A1 | 12/2005 | Kok | |
| 2006/0072768 | A1 | 4/2006 | Schwartz et al. | |
| 2006/0074646 | A1 | 4/2006 | Alves et al. | |
| 2006/0098809 | A1 | 5/2006 | Nongpiur et al. | |
| 2006/0120537 | A1 | 6/2006 | Burnett et al. | |
| 2006/0133621 | A1 | 6/2006 | Chen et al. | |
| 2006/0149535 | A1 | 7/2006 | Choi et al. | |
| 2006/0184363 | A1 | 8/2006 | McCree et al. | |
| 2006/0198542 | A1 | 9/2006 | Benjelloun Touimi et al. | |
| 2006/0222184 | A1 | 10/2006 | Buck et al. | |
| 2007/0021958 | A1 | 1/2007 | Visser et al. | |
| 2007/0027685 | A1 | 2/2007 | Arakawa et al. | |
| 2007/0033020 | A1 | 2/2007 | (Kelleher) Francois et al. | |
| 2007/0067166 | A1 | 3/2007 | Pan et al. | |
| 2007/0078649 | A1 | 4/2007 | Hetherington et al. | |
| 2007/0094031 | A1 | 4/2007 | Chen | |
| 2007/0100612 | A1 | 5/2007 | Ekstrand et al. | |
| 2007/0116300 | A1 | 5/2007 | Chen | |
| 2007/0150268 | A1 | 6/2007 | Acero et al. | |
| 2007/0154031 | A1 | 7/2007 | Avendano et al. | |
| 2007/0165879 | A1 | 7/2007 | Deng et al. | |
| 2007/0195968 | A1 | 8/2007 | Jaber | |
| 2007/0230712 | A1 | 10/2007 | Belt et al. | |
| 2007/0276656 | A1 | 11/2007 | Solbach et al. | |
| 2008/0019548 | A1* | 1/2008 | Avendano | 381/313 |
| 2008/0033723 | A1 | 2/2008 | Jang et al. | |
| 2008/0140391 | A1 | 6/2008 | Yen et al. | |
| 2008/0201138 | A1 | 8/2008 | Visser et al. | |
| 2008/0228474 | A1 | 9/2008 | Huang et al. | |
| 2008/0228478 | A1 | 9/2008 | Hetherington et al. | |
| 2008/0260175 | A1 | 10/2008 | Elko | |
| 2009/0012783 | A1 | 1/2009 | Klein | |
| 2009/0012786 | A1 | 1/2009 | Zhang et al. | |
| 2009/0089054 | A1 | 4/2009 | Wang et al. | |
| 2009/0129610 | A1 | 5/2009 | Kim et al. | |
| 2009/0220107 | A1 | 9/2009 | Every et al. | |
| 2009/0238373 | A1 | 9/2009 | Klein | |
| 2009/0253418 | A1 | 10/2009 | Makinen | |
| 2009/0271187 | A1 | 10/2009 | Yen et al. | |
| 2010/0036659 | A1 | 2/2010 | Haulick et al. | |
| 2010/0094622 | A1 | 4/2010 | Cardillo et al. | |
| 2010/0094643 | A1 | 4/2010 | Avendano et al. | |
| 2010/0278352 | A1 | 11/2010 | Petit et al. | |
| 2011/0178800 | A1 | 7/2011 | Watts | |
| 2011/0286605 | A1 | 11/2011 | Furuta et al. | |
| 2011/0305345 | A1 | 12/2011 | Bouchard et al. | |
| 2013/0034243 | A1 | 2/2013 | Yermeche et al. | |

FOREIGN PATENT DOCUMENTS

| | | |
|---|---|---|
| JP | 5053587 | 3/1993 |
| JP | 05-172865 | 7/1993 |
| JP | 06269083 | 9/1994 |
| JP | H07248793 | 9/1995 |
| JP | 10-313497 | 11/1998 |
| JP | 11-249693 | 9/1999 |
| JP | 2004053895 | 2/2004 |
| JP | 2004531767 | 10/2004 |
| JP | 2004533155 | 10/2004 |
| JP | 2005110127 | 4/2005 |
| JP | 2005148274 | 6/2005 |
| JP | 2005518118 | 6/2005 |
| JP | 2005195955 | 7/2005 |
| JP | 2007006525 | 1/2007 |
| TW | 526468 | 4/2003 |
| TW | I279776 | 4/2007 |
| WO | 01/74118 | 10/2001 |
| WO | 02080362 | 10/2002 |
| WO | 02103676 | 12/2002 |
| WO | 03/043374 | 5/2003 |
| WO | 03/069499 | 8/2003 |
| WO | 03069499 | 8/2003 |
| WO | 2004/010415 | 1/2004 |
| WO | 2007/081916 | 7/2007 |
| WO | 2007/140003 | 12/2007 |
| WO | 2010/005493 | 1/2010 |

OTHER PUBLICATIONS

Dahl, Mattias et al., "Simultaneous Echo Cancellation and Car Noise Suppression Employing a Microphone Array", 1997 IEEE International Conference on Acoustics, Speech, and Signal Processing, Apr. 21-24, pp. 239-242.

"Ent 172." Instructional Module. Prince George's Community College Department of Engineering Technology. Accessed: Oct. 15, 2011. Subsection: "Polar and Rectangular Notation". <http://academic.ppgcc.edu/ent/ent172_instr_mod.html>.

Fulghum, D. P. et al., "LPC Voice Digitizer with Background Noise Suppression", 1979 IEEE International Conference on Acoustics, Speech, and Signal Processing, pp. 220-223.

Graupe, Daniel et al., "Blind Adaptive Filtering of Speech from Noise of Unknown Spectrum Using a Virtual Feedback Configuration", IEEE Transactions on Speech and Audio Processing, Mar. 2000, vol. 8, No. 2, pp. 146-158.

(56) References Cited

OTHER PUBLICATIONS

Haykin, Simon et al. "Appendix A.2 Complex Numbers." Signals and Systems. 2nd Ed. 2003. p. 764.
Hermansky, Hynek "Should Recognizers Have Ears?", In Proc. ESCA Tutorial and Research Workshop on Robust Speech Recognition for Unknown Communication Channels, pp. 1-10, France 1997.
Hohmann, V. "Frequency Analysis and Synthesis Using a Gammatone Filterbank", ACTA Acustica United with Acustica, 2002, vol. 88, pp. 433-442.
Jeffress, Lloyd A. et al. "A Place Theory of Sound Localization," Journal of Comparative and Physiological Psychology, 1948, vol. 41, p. 35-39.
Jeong, Hyuk et al., "Implementation of a New Algorithm Using the STFT with Variable Frequency Resolution for the Time-Frequency Auditory Model", J. Audio Eng. Soc., Apr. 1999, vol. 47, No. 4., pp. 240-251.
Kates, James M. "A Time-Domain Digital Cochlear Model", IEEE Transactions on Signal Processing, Dec. 1991, vol. 39, No. 12, pp. 2573-2592.
Lazzaro, John et al., "A Silicon Model of Auditory Localization," Neural Computation Spring 1989, vol. 1, pp. 47-57, Massachusetts Institute of Technology.
Lippmann, Richard P. "Speech Recognition by Machines and Humans", Speech Communication, Jul. 1997, vol. 22, No. 1, pp. 1-15.
Martin, Rainer "Spectral Subtraction Based on Minimum Statistics", in Proceedings Europe. Signal Processing Conf., 1994, pp. 1182-1185.
Mitra, Sanjit K. Digital Signal Processing: a Computer-based Approach. 2nd Ed. 2001. pp. 131-133.
Watts, Lloyd Narrative of Prior Disclosure of Audio Display on Feb. 15, 2000 and May 31, 2000.
Cosi, Piero et al. (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Rabiner, Lawrence R. et al. "Digital Processing of Speech Signals", (Prentice-Hall Series in Signal Processing). Upper Saddle River, NJ: Prentice Hall, 1978.
Weiss, Ron et al., "Estimating Single-Channel Source Separation Masks: Revelance Vector Machine Classifiers vs. Pitch-Based Masking", Workshop on Statistical and Perceptual Audio Processing, 2006.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, "Lyon's Cochlear Model", Advanced Technology Group, Apple Technical Report #13, Apple Computer, Inc., 1988, pp. 1-79.
Slaney, Malcom, et al. "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg-Harburg, 1998.
Syntrillium Software Corporation, "Cool Edit User's Manual", 1996, pp. 1-74.
Tchorz, Jurgen et al., "SNR Estimation Based on Amplitude Modulation Analysis with Applications to Noise Suppression", IEEE Transactions on Speech and Audio Processing, vol. 11, No. 3, May 2003, pp. 184-192.
Watts, Lloyd, "Robust Hearing Systems for Intelligent Machines," Applied Neurosystems Corporation, 2001, pp. 1-5.
Yoo, Heejong et al., "Continuous-Time Audio Noise Suppression and Real-Time Implementation", 2002 IEEE International Conference on Acoustics, Speech, and Signal Processing, May 13-17, pp. IV3980-IV3983.
International Search Report dated Jun. 8, 2001 in Application No. PCT/US01/08372.
International Search Report dated Apr. 3, 2003 in Application No. PCT/US02/36946.
International Search Report dated May 29, 2003 in Application No. PCT/US03/04124.
International Search Report and Written Opinion dated Sep. 16, 2008 in Application No. PCT/US07/12628.
International Search Report and Written Opinion dated May 11, 2009 in Application No. PCT/US09/01667.
International Search Report and Written Opinion dated May 20, 2010 in Application No. PCT/US09/06754.
Fast Cochlea Transform, US Trademark Reg. No. 2,875,755 (Aug. 17, 2004).
Dahl, Mattias et al., "Acoustic Echo and Noise Cancelling Using Microphone Arrays", International Symposium on Signal Processing and its Applications, ISSPA, Gold coast, Australia, Aug. 25-30, 1996, pp. 379-382.
Demol, M. et al. "Efficient Non-Uniform Time-Scaling of Speech With WSOLA for Call Applications", Proceedings of InSTIL/ICALL2004—NLP and Speech Technologies in Advanced Language Learning Systems—Venice Jun. 17-19, 2004.
Laroche, Jean. "Time and Pitch Scale Modification of Audio Signals", in "Applications of Digital Signal Processing to Audio and Acoustics", The Kluwer International Series in Engineering and Computer Science, vol. 437, pp. 279-309, 2002.
Moulines, Eric et al., "Non-Parametric Techniques for Pitch-Scale and Time-Scale Modification of Speech", Speech Communication, vol. 16, pp. 175-205, 1995.
Verhelst, Werner, "Overlap-Add Methods for Time-Scaling of Speech", Speech Communication vol. 30, pp. 207-221, 2000.
Avendano, C., "Frequency-Domain Techniques for Source Identification and Manipulation in Stereo Mixes for Enhancement, Suppression and Re-Panning Applications," in Proc. IEEE Workshop on Application of Signal Processing to Audio and Acoustics, Waspaa, 03, New Paltz, NY, 2003.
Elko, Gary W., "Differential Microphone Arrays,"Audio Signal Processing for Next-Generation Multimedia Communication Systems, 2004, pp. 12-65, Kluwer Academic Publishers, Norwell, Massachusetts, USA.
B. Widrow et al., "Adaptive Antenna Systems," Proceedings IEEE, vol. 55, No. 12, pp. 2143-2159, Dec. 1967.
Allen, Jont B. "Short Term Spectral Analysis, and Modification by Discrete Fourier Transform", IEEE Transactions on Acoustics, Speech, and Signal Processing. vol. ASSP-25, 3. Jun. 1977. pp. 235-238.
Allen, Jont B. et al. "A Unified Approach to Short-Time Fourier Analysis and Synthesis", Proceedings of the IEEE. vol. 65, 11, Nov. 1977. pp. 1558-1564.
Boll, Steven F. "Suppression of Acoustic Noise in Speech Using Spectral Subtraction", Dept. of Computer Science, University of Utah Salt Lake City, Utah, Apr. 1979, pp. 18-19.
Boll, Steven et al. "Suppression of Acoustic Noise in Speech Using Two Microphone Adaptive Noise Cancellation", source(s): IEEE Transactions on Acoustic, Speech, and Signal Processing. vol. v ASSSP-28, n 6, Dec. 1980, pp. 752-753.
Chen, Jingdong et al. "New Insights into the Noise Reduction Wierner Filter", source(s): IEEE Transactions on Audio, Speech, and Language Processing. vol. 14, 4, Jul. 2006, pp. 1218-1234.
Cohen, Isreal, "Mutichannel Post-Filtering in Nonstationary Noise Environment", source(s): IEEE Transactions on Signal Processing. vol. 52, 5, May 2004, pp. 1149-1160.
Cohen et al. "Microphone Array Post-Filtering for Non-Stationary Noise", source(s): IEEE, May 2002.
Fuchs, Martin et al. "Noise Suppression for Automotive Applications Based on Directional Information", source(s): 2004 IEEE. pp. 237-240.
Goubran, R.A. . "Acoustic Noise Suppression Using Regression Adaptive Filtering", source(s): 1990 IEEE. pp. 48-53.

(56) References Cited

OTHER PUBLICATIONS

Liu, Chen et al. "A two-microphone dual delay-line approach for extraction of a speech sound in the pressence of multiple interferers", source(s): Acoustical Society of America. vol. 110, 6, Dec. 2001, pp. 3218-3231.

Martin, Rainer et al. "Combined Acoustic Echo Cancellation, Derverberation and Noise Reduction: A two Microphone Approach", source(s): Annles des Telecommunications of Telecommunications. vol. 29, 7-8, Jul.-Aug. 1994, pp. 429-438.

Mizumachi, Mitsunori et al. "Noise Reduction by Paired-Microphones Using Spectral Subtraction", source(s): 1998 IEEE. pp. 1001-1004.

Moonen, Marc et at. "Multi-Microphone Signal Enhancement Techniques for Noise Suppression and Dereverbration," source(s): http://www.esat.kuleuven.ac.be/sista/yearreport97/node37.html.

Parra, Lucas et al. "Convolutive blind Separation of Non-Stationary", source(s): IEEE Transactions on Speech and Audio Processing. vol. 8, 3, May 2008, pp. 320-327.

Tashev, Ivan et al. "Microphone Array of Headset with Spatial Noise Suppressor", source(s): http://research.microsoft.com/users/ivantash/Documents/Tashev_MAforHeadset_HSCMA_05.pdf. (4 pages).

Valin, Jean-Marc et al. "Enhanced Robot Audition Based on Micophone Array Source Separation with Post-Filter", source(s): Proceedings of 2004 IEEE/RSJ International Conference on Intelligent Robots and Systems, Sep. 28-Oct. 2, 2004, Sendai, Japan. pp. 2123-2128.

Stahl, V.; Fischer, A.; Bippus, R.; "Quantile based noise estimation for spectral subtraction and Wiener filtering," Acoustics, Speech, and Signal Processing, 2000. ICASSP '00. Proceedings. 2000 IEEE International Conference on, vol. 3, no., pp. 1875-1878 vol. 3, 2000.

International Search Report and Written Opinion dated Aug. 27, 2009 in Application No. PCT/US09/03813.

International Search Report and Written Opinion dated Oct. 19, 2007 in Application No. PCT/US07/00463.

International Search Report and Written Opinion dated Oct. 1, 2008 in Application No. PCT/US08/08249.

International Search Report and Written Opinion dated Apr. 9, 2008 in Application No. PCT/US07/21654.

Notice of Allowance, Jun. 5, 2014, U.S. Appl. No. 12/228,034, filed Aug. 8, 2008.

Office Action, May 13, 2014, U.S. Appl. No. 12/962,519, filed Dec. 7, 2010.

Office Action, Jul. 15, 2014, U.S. Appl. No. 13/432,490, filed Mar. 28, 2012.

Notice of Allowance, Jul. 16, 2014, U.S. Appl. No. 13/426,436, filed Mar. 21, 2012.

Notice of Allowance, Jun. 19, 2014, U.S. Appl. No. 13/705,132, filed Dec. 4, 2012.

Allowance mailed May 21, 2014 in Finnish Patent Application 20100001, filed Jan. 4, 2010.

Office Action mailed May 2, 2014 in Taiwanese Patent Application 098121933, filed Jun. 29, 2009.

Office Action mailed Jun. 27, 2014 in Korean Patent Application No. 10-2010-7000194, filed Jan. 6, 2010.

Office Action mailed Jun. 18, 2014 in Finnish Patent Application No. 20080428, filed Jul. 4, 2008.

* cited by examiner

SYSTEM AND METHOD FOR PROVIDING NOISE SUPPRESSION UTILIZING NULL PROCESSING NOISE SUBTRACTION

CROSS-REFERENCE TO RELATED APPLICATION

The present application is related to U.S. patent application Ser. No. 11/825,563, filed Jul. 6, 2007 and entitled "System and Method for Adaptive Intelligent Noise Suppression," (now U.S. Pat. No. 8,774,844), and U.S. patent application Ser. No. 12/080,115, filed Mar. 31, 2008 and entitled "System and Method for Providing Close Microphone Adaptive Array Processing," (now U.S. Pat. No. 8,204,252), both of which are herein incorporated by reference.

The present application is also related to U.S. patent application Ser. No. 11/343,524, filed Jan. 30, 2006 and entitled "System and Method for Utilizing Inter-Microphone Level Differences for Speech Enhancement," (now U.S. Pat. No. 8,345,890), and U.S. patent application Ser. No. 11/699,732, filed Jan. 29, 2007 and entitled "System and Method for Utilizing Omni-Directional Microphones for Speech Enhancement," (now U.S. Pat. No. 8,194,880), both of which are herein incorporated by reference.

BACKGROUND OF THE INVENTION

1. Field of Invention

The present invention relates generally to audio processing and more particularly to adaptive noise suppression of an audio signal.

2. Description of Related Art

Currently, there are many methods for reducing background noise in an adverse audio environment. One such method is to use a stationary noise suppression system. The stationary noise suppression system will always provide an output noise that is a fixed amount lower than the input noise. Typically, the stationary noise suppression is in the range of 12-13 decibels (dB). The noise suppression is fixed to this conservative level in order to avoid producing speech distortion, which will be apparent with higher noise suppression.

In order to provide higher noise suppression, dynamic noise suppression systems based on signal-to-noise ratios (SNR) have been utilized. This SNR may then be used to determine a suppression value. Unfortunately, SNR, by itself, is not a very good predictor of speech distortion due to existence of different noise types in the audio environment. SNR is a ratio of how much louder speech is than noise. However, speech may be a non-stationary signal which may constantly change and contain pauses. Typically, speech energy, over a period of time, will comprise a word, a pause, a word, a pause, and so forth. Additionally, stationary and dynamic noises may be present in the audio environment. The SNR averages all of these stationary and non-stationary speech and noise. There is no consideration as to the statistics of the noise signal; only what the overall level of noise is.

In some prior art systems, an enhancement filter may be derived based on an estimate of a noise spectrum. One common enhancement filter is the Wiener filter. Disadvantageously, the enhancement filter is typically configured to minimize certain mathematical error quantities, without taking into account a user's perception. As a result, a certain amount of speech degradation is introduced as a side effect of the noise suppression. This speech degradation will become more severe as the noise level rises and more noise suppression is applied. That is, as the SNR gets lower, lower gain is applied resulting in more noise suppression. This introduces more speech loss distortion and speech degradation.

Some prior art systems invoke a generalized side-lobe canceller. The generalized side-lobe canceller is used to identify desired signals and interfering signals comprised by a received signal. The desired signals propagate from a desired location and the interfering signals propagate from other locations. The interfering signals are subtracted from the received signal with the intention of cancelling interference.

Many noise suppression processes calculate a masking gain and apply this masking gain to an input signal. Thus, if an audio signal is mostly noise, a masking gain that is a low value may be applied (i.e., multiplied to) the audio signal. Conversely, if the audio signal is mostly desired sound, such as speech, a high value gain mask may be applied to the audio signal. This process is commonly referred to as multiplicative noise suppression.

SUMMARY OF THE INVENTION

Embodiments of the present invention overcome or substantially alleviate prior problems associated with noise suppression and speech enhancement. In exemplary embodiments, at least a primary and a secondary acoustic signal are received by a microphone array. The microphone array may comprise a close microphone array or a spread microphone array.

A noise component signal may be determined in each sub-band of signals received by the microphone by subtracting the primary acoustic signal weighted by a complex-valued coefficient $\sigma$ from the secondary acoustic signal. The noise component signal, weighted by another complex-valued coefficient $\alpha$, may then be subtracted from the primary acoustic signal resulting in an estimate of a target signal (i.e., a noise subtracted signal).

A determination may be made as to whether to adjust $\alpha$. In exemplary embodiments, the determination may be based on a reference energy ratio ($g_1$) and a prediction energy ratio ($g_2$). The complex-valued coefficient $\alpha$ may be adapted when the prediction energy ratio is greater than the reference energy ratio to adjust the noise component signal. Conversely, the adaptation coefficient may be frozen when the prediction energy ratio is less than the reference energy ratio. The noise component signal may then be removed from the primary acoustic signal to generate a noise subtracted signal which may be outputted.

DESCRIPTION OF EXEMPLARY EMBODIMENTS

The present invention provides exemplary systems and methods for adaptive suppression of noise in an audio signal. Embodiments attempt to balance noise suppression with minimal or no speech degradation (i.e., speech loss distortion). In exemplary embodiments, noise suppression is based on an audio source location and applies a subtractive noise suppression process as opposed to a purely multiplicative noise suppression process.

Embodiments of the present invention may be practiced on any audio device that is configured to receive sound such as, but not limited to, cellular phones, phone handsets, headsets, and conferencing systems. Advantageously, exemplary embodiments are configured to provide improved noise suppression while minimizing speech distortion. While some embodiments of the present invention will be described in reference to operation on a cellular phone, the present invention may be practiced on any audio device.

Figure 1:
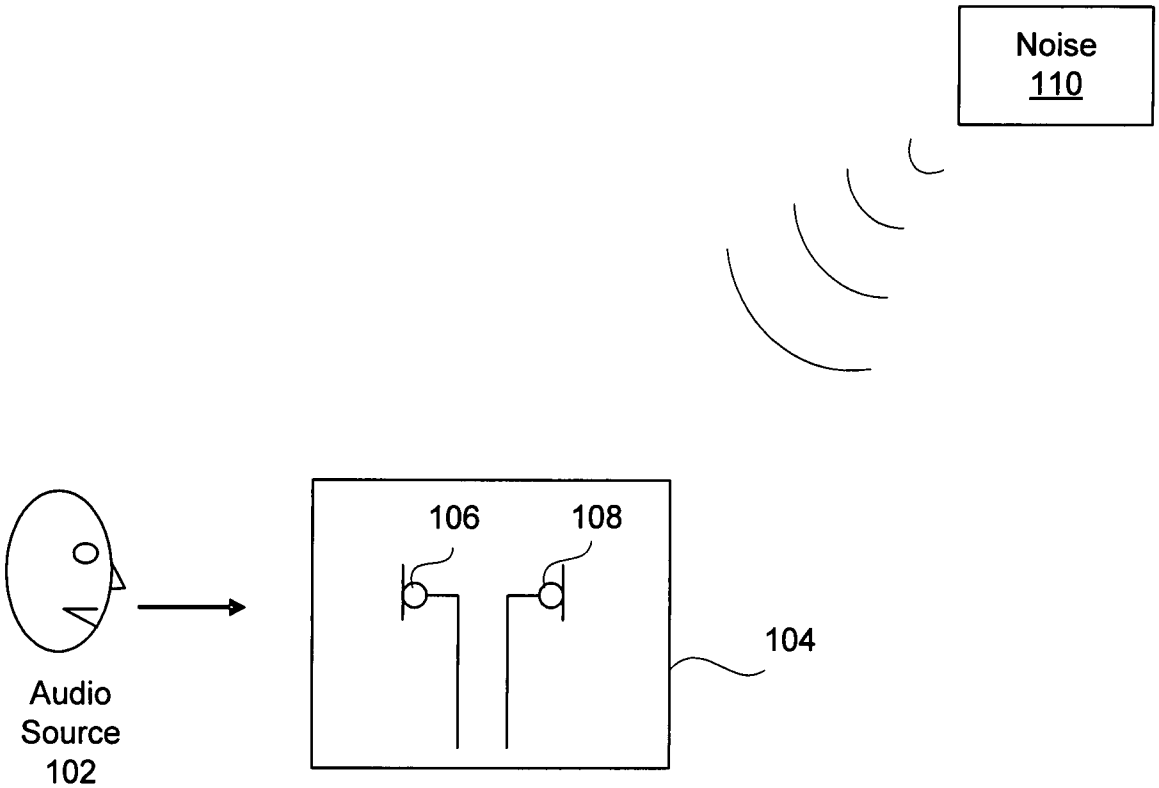
FIG. 1 is an environment in which embodiments of the present invention may be practiced.

Referring to FIG. 1, an environment in which embodiments of the present invention may be practiced is shown. A user acts as a speech (audio) source 102 to an audio device 104. The exemplary audio device 104 may include a microphone array. The microphone array may comprise a close microphone array or a spread microphone array.

In exemplary embodiments, the microphone array may comprise a primary microphone 106 relative to the audio source 102 and a secondary microphone 108 located a distance away from the primary microphone 106. While embodiments of the present invention will be discussed with regards to having two microphones 106 and 108, alternative embodiments may contemplate any number of microphones or acoustic sensors within the microphone array. In some embodiments, the microphones 106 and 108 may comprise omni-directional microphones.

While the microphones 106 and 108 receive sound (i.e., acoustic signals) from the audio source 102, the microphones 106 and 108 also pick up noise 110. Although the noise 110 is shown coming from a single location in FIG. 1, the noise 110 may comprise any sounds from one or more locations different than the audio source 102, and may include reverberations and echoes. The noise 110 may be stationary, non-stationary, or a combination of both stationary and non-stationary noise.

Figure 2:
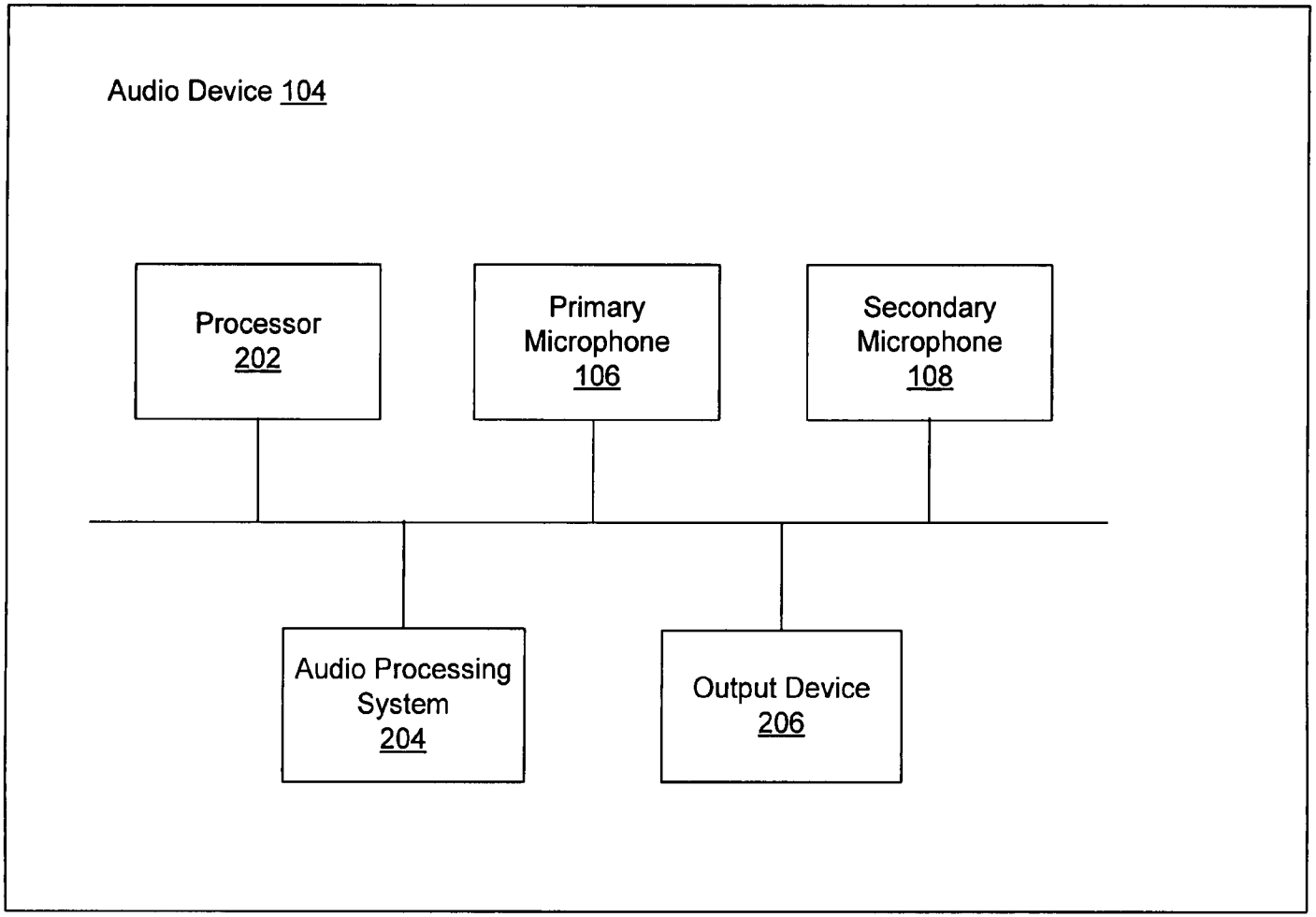
FIG. 2 is a block diagram of an exemplary audio device implementing embodiments of the present invention.

Referring now to FIG. 2, the exemplary audio device 104 is shown in more detail. In exemplary embodiments, the audio device 104 is an audio receiving device that comprises a processor 202, the primary microphone 106, the secondary microphone 108, an audio processing system 204, and an output device 206. The audio device 104 may comprise further components (not shown) necessary for audio device 104 operations. The audio processing system 204 will be discussed in more details in connection with FIG. 3.

In exemplary embodiments, the primary and secondary microphones 106 and 108 are spaced a distance apart in order to allow for an energy level difference between them. Upon reception by the microphones 106 and 108, the acoustic signals may be converted into electric signals (i.e., a primary electric signal and a secondary electric signal). The electric signals may, themselves, be converted by an analog-to-digital converter (not shown) into digital signals for processing in accordance with some embodiments. In order to differentiate the acoustic signals, the acoustic signal received by the primary microphone 106 is herein referred to as the primary acoustic signal, while the acoustic signal received by the secondary microphone 108 is herein referred to as the secondary acoustic signal.

The output device 206 is any device which provides an audio output to the user. For example, the output device 206 may comprise an earpiece of a headset or handset, or a speaker on a conferencing device.

Figure 3:
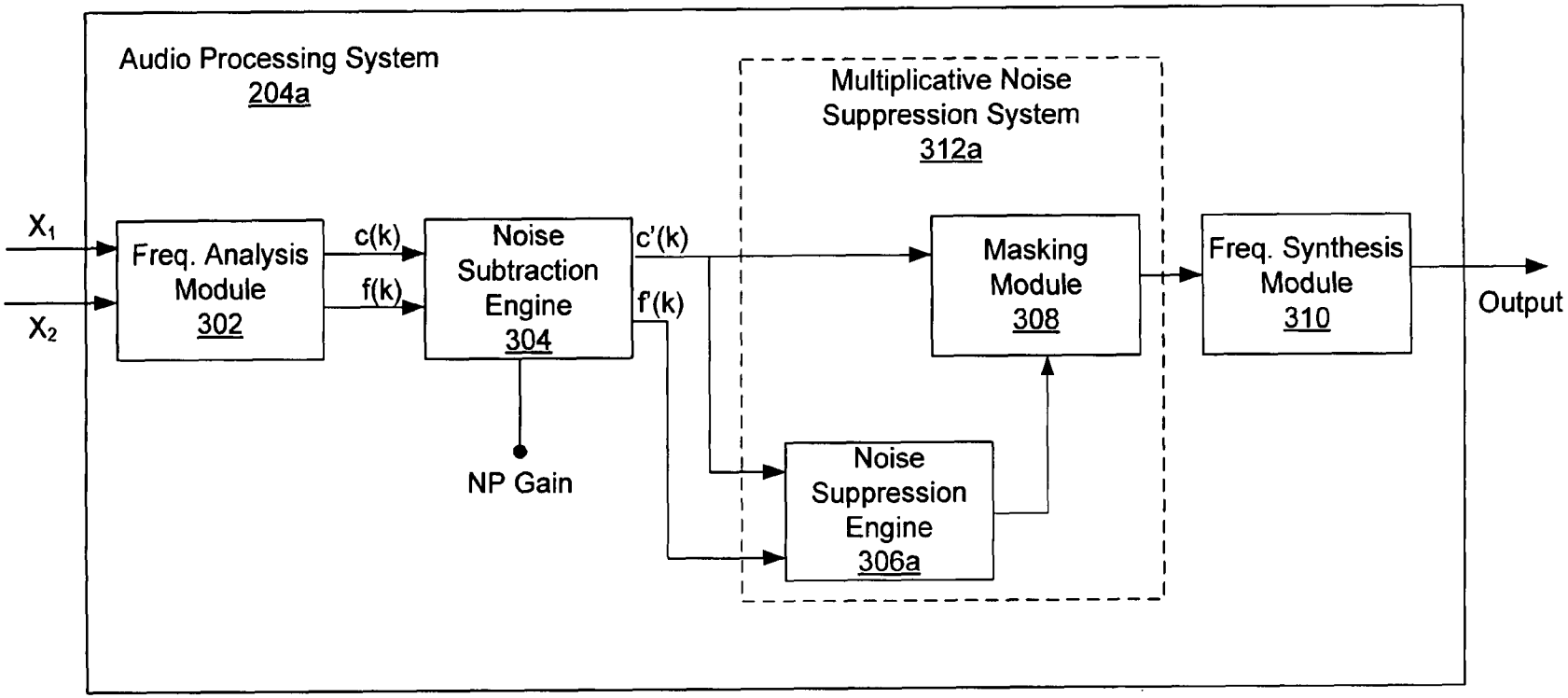
FIG. 3 is a block diagram of an exemplary audio processing system utilizing a spread microphone array.

FIG. 3 is a detailed block diagram of the exemplary audio processing system 204*a* according to one embodiment of the present invention. In exemplary embodiments, the audio processing system 204*a* is embodied within a memory device. The audio processing system 204*a* of FIG. 3 may be utilized in embodiments comprising a spread microphone array.

In operation, the acoustic signals received from the primary and secondary microphones 106 and 108 are converted to electric signals and processed through a frequency analysis module 302. In one embodiment, the frequency analysis module 302 takes the acoustic signals and mimics the frequency analysis of the cochlea (i.e., cochlear domain) simulated by a filter bank. In one example, the frequency analysis module 302 separates the acoustic signals into frequency sub-bands. A sub-band is the result of a filtering operation on an input signal where the bandwidth of the filter is narrower than the bandwidth of the signal received by the frequency analysis module 302. Alternatively, other filters such as short-time Fourier transform (STFT), sub-band filter banks, modulated complex lapped transforms, cochlear models, wavelets, etc., can be used for the frequency analysis and synthesis. Because most sounds (e.g., acoustic signals) are complex and comprise more than one frequency, a sub-band analysis on the acoustic signal determines what individual frequencies are present in the complex acoustic signal during a frame (e.g., a predetermined period of time). According to one embodiment, the frame is 8 ms long. Alternative embodiments may utilize other frame lengths or no frame at all. The results may comprise sub-band signals in a fast cochlea transform (FCT) domain.

Once the sub-band signals are determined, the sub-band signals are forwarded to a noise subtraction engine 304. The exemplary noise subtraction engine 304 is configured to adaptively subtract out a noise component from the primary acoustic signal for each sub-band. As such, output of the noise subtraction engine 304 is a noise subtracted signal comprised of noise subtracted sub-band signals. The noise subtraction engine 304 will be discussed in more detail in connection with FIG. 7*a* and FIG. 7*b*. It should be noted that the noise subtracted sub-band signals may comprise desired audio that is speech or non-speech (e.g., music). The results of the noise subtraction engine 304 may be output to the user or processed through a further noise suppression system (e.g., the noise suppression engine 306). For purposes of illustration, embodiments of the present invention will discuss embodiments whereby the output of the noise subtraction engine 304 is processed through a further noise suppression system.

The noise subtracted sub-band signals along with the sub-band signals of the secondary acoustic signal are then provided to the noise suppression engine 306*a*. According to exemplary embodiments, the noise suppression engine 306*a* generates a gain mask to be applied to the noise subtracted sub-band signals in order to further reduce noise components that remain in the noise subtracted speech signal. The noise suppression engine 306*a* will be discussed in more detail in connection with FIG. 4 below.

The gain mask determined by the noise suppression engine 306*a* may then be applied to the noise subtracted signal in a masking module 308. Accordingly, each gain mask may be applied to an associated noise subtracted frequency sub-band to generate masked frequency sub-bands. As depicted in FIG. 3, a multiplicative noise suppression system 312*a* comprises the noise suppression engine 306*a* and the masking module 308.

Next, the masked frequency sub-bands are converted back into time domain from the cochlea domain. The conversion may comprise taking the masked frequency sub-bands and adding together phase shifted signals of the cochlea channels in a frequency synthesis module 310. Alternatively, the conversion may comprise taking the masked frequency sub-bands and multiplying these with an inverse frequency of the cochlea channels in the frequency synthesis module 310. Once conversion is completed, the synthesized acoustic signal may be output to the user.

Figure 4:
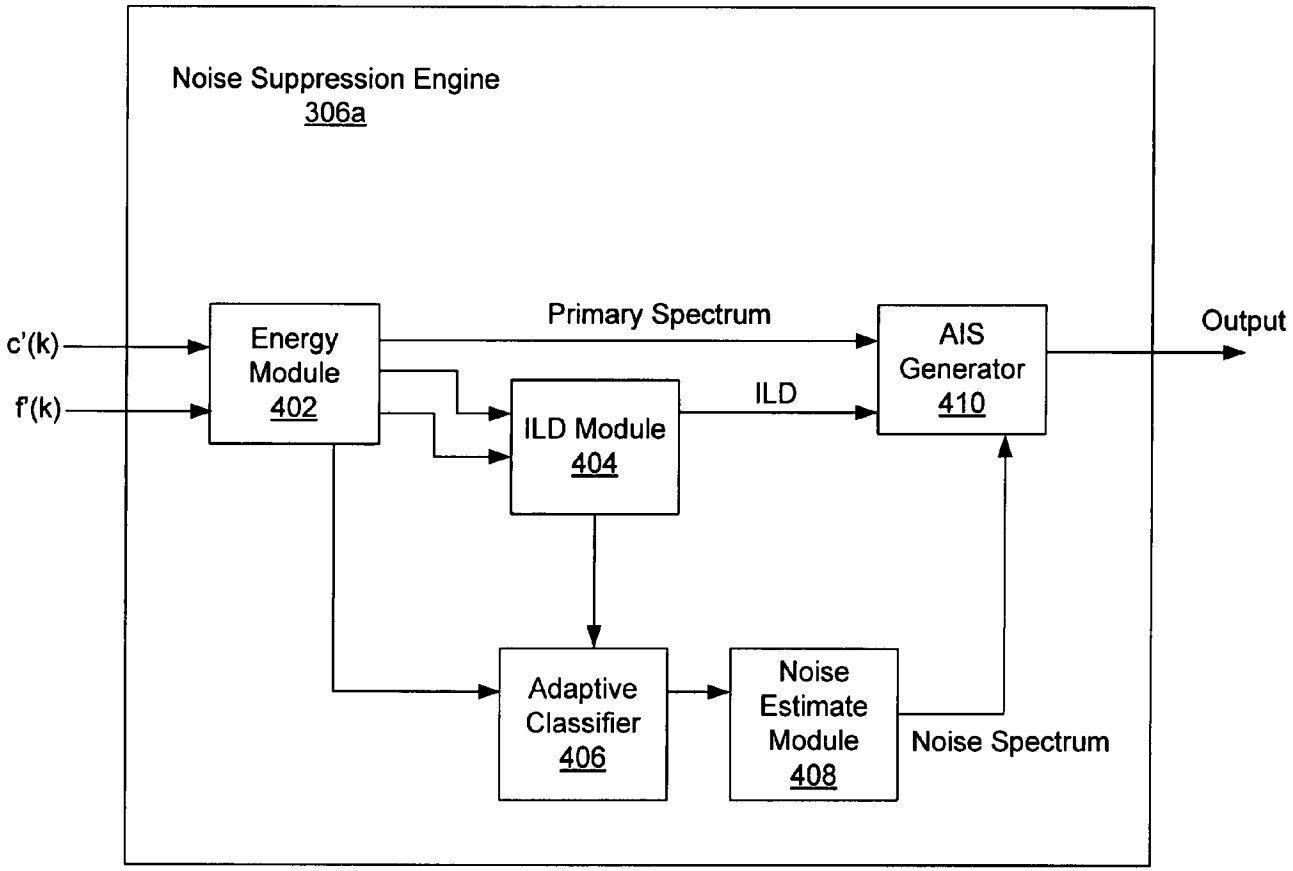
FIG. 4 is a block diagram of an exemplary noise suppression system of the audio processing system of FIG. 3.

Referring now to FIG. 4, the noise suppression engine 306*a* of FIG. 3 is illustrated. The exemplary noise suppression engine 306*a* comprises an energy module 402, an inter-microphone level difference (ILD) module 404, an adaptive classifier 406, a noise estimate module 408, and an adaptive intelligent suppression (AIS) generator 410. It should be noted that the noise suppression engine 306*a* is exemplary and may comprise other combinations of modules such as that shown and described in U.S. patent application Ser. No. 11/343,524, which is incorporated by reference.

According to an exemplary embodiment of the present invention, the AIS generator 410 derives time and frequency varying gains or gain masks used by the masking module 308 to suppress noise and enhance speech in the noise subtracted signal. In order to derive the gain masks, however, specific inputs are needed for the AIS generator 410. These inputs comprise a power spectral density of noise (i.e., noise spectrum), a power spectral density of the noise subtracted signal (herein referred to as the primary spectrum), and an inter-microphone level difference (ILD).

Figure 7B:
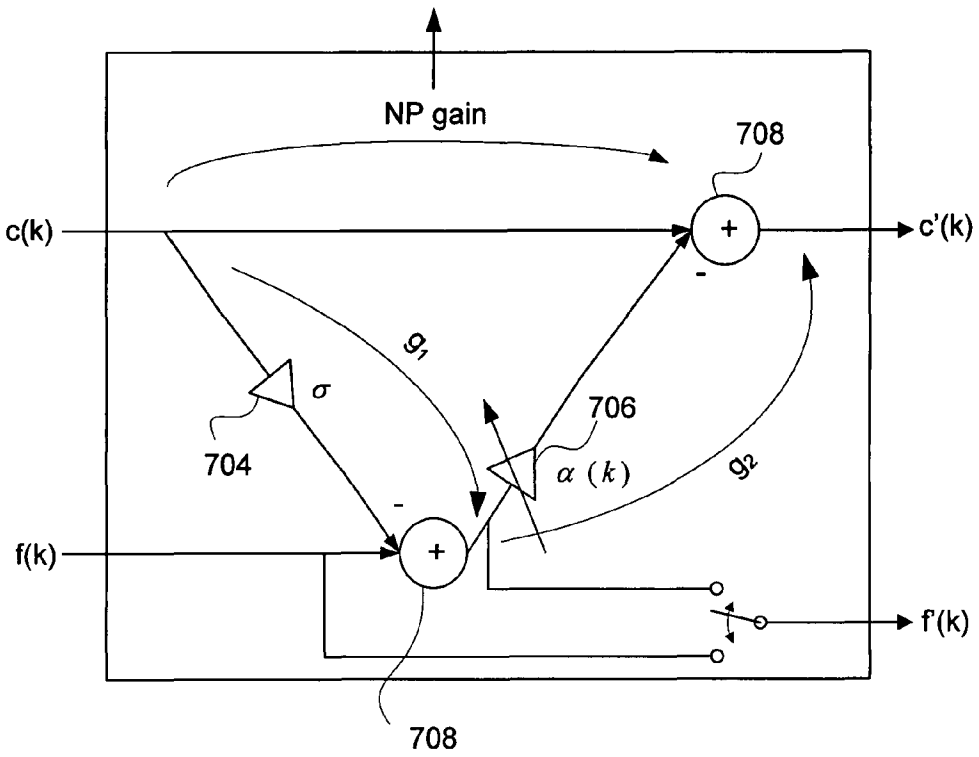
FIG. 7*b* is a schematic illustrating the operations of the noise subtraction engine.

According to exemplary embodiment, the noise subtracted signal (c'(k)) resulting from the noise subtraction engine 304 and the secondary acoustic signal (f'(k)) are forwarded to the energy module 402 which computes energy/power estimates during an interval of time for each frequency band (i.e., power estimates) of an acoustic signal. As can be seen in FIG. 7*b*, f'(k) may optionally be equal to f(k). As a result, the primary spectrum (i.e., the power spectral density of the noise subtracted signal) across all frequency bands may be determined by the energy module 402. This primary spectrum may be supplied to the AIS generator 410 and the ILD module 404 (discussed further herein). Similarly, the energy module 402 determines a secondary spectrum (i.e., the power spectral density of the secondary acoustic signal) across all frequency bands which is also supplied to the ILD module 404. More details regarding the calculation of power estimates and power spectrums can be found in co-pending U.S. patent application Ser. No. 11/343,524 and co-pending U.S. patent application Ser. No. 11/699,732, which are incorporated by reference.

In two microphone embodiments, the power spectrums are used by an inter-microphone level difference (ILD) module 404 to determine an energy ratio between the primary and secondary microphones 106 and 108. In exemplary embodiments, the ILD may be a time and frequency varying ILD. Because the primary and secondary microphones 106 and 108 may be oriented in a particular way, certain level differences may occur when speech is active and other level differences may occur when noise is active. The ILD is then forwarded to the adaptive classifier 406 and the AIS generator 410. More details regarding one embodiment for calculating ILD may be can be found in co-pending U.S. patent application Ser. No. 11/343,524 and co-pending U.S. patent application Ser. No. 11/699,732. In other embodiments, other forms of ILD or energy differences between the primary and secondary microphones 106 and 108 may be utilized. For example, a ratio of the energy of the primary and secondary microphones 106 and 108 may be used. It should also be noted that alternative embodiments may use cues other then ILD for adaptive classification and noise suppression (i.e., gain mask calculation). For example, noise floor thresholds may be used. As such, references to the use of ILD may be construed to be applicable to other cues.

The exemplary adaptive classifier 406 is configured to differentiate noise and distractors (e.g., sources with a negative ILD) from speech in the acoustic signal(s) for each frequency band in each frame. The adaptive classifier 406 is considered adaptive because features (e.g., speech, noise, and distractors) change and are dependent on acoustic conditions in the environment. For example, an ILD that indicates speech in one situation may indicate noise in another situation. Therefore, the adaptive classifier 406 may adjust classification boundaries based on the ILD.

According to exemplary embodiments, the adaptive classifier 406 differentiates noise and distractors from speech and provides the results to the noise estimate module 408 which derives the noise estimate. Initially, the adaptive classifier 406 may determine a maximum energy between channels at each frequency. Local ILDs for each frequency are also determined. A global ILD may be calculated by applying the energy to the local ILDs. Based on the newly calculated global ILD, a running average global ILD and/or a running mean and variance (i.e., global cluster) for ILD observations may be updated. Frame types may then be classified based on a position of the global ILD with respect to the global cluster. The frame types may comprise source, background, and distractors.

Once the frame types are determined, the adaptive classifier 406 may update the global average running mean and variance (i.e., cluster) for the source, background, and distractors. In one example, if the frame is classified as source, background, or distracter, the corresponding global cluster is considered active and is moved toward the global ILD. The global source, background, and distractor global clusters that do not match the frame type are considered inactive. Source and distractor global clusters that remain inactive for a predetermined period of time may move toward the background global cluster. If the background global cluster remains inactive for a predetermined period of time, the background global cluster moves to the global average.

Once the frame types are determined, the adaptive classifier 406 may also update the local average running mean and variance (i.e., cluster) for the source, background, and distractors. The process of updating the local active and inactive clusters is similar to the process of updating the global active and inactive clusters.

Based on the position of the source and background clusters, points in the energy spectrum are classified as source or noise; this result is passed to the noise estimate module 408.

In an alternative embodiment, an example of an adaptive classifier 406 comprises one that tracks a minimum ILD in each frequency band using a minimum statistics estimator. The classification thresholds may be placed a fixed distance (e.g., 3 dB) above the minimum ILD in each band. Alternatively, the thresholds may be placed a variable distance above the minimum ILD in each band, depending on the recently observed range of ILD values observed in each band. For example, if the observed range of ILDs is beyond 6 dB, a threshold may be place such that it is midway between the minimum and maximum ILDs observed in each band over a certain specified period of time (e.g., 2 seconds). The adaptive classifier is further discussed in the U.S. nonprovisional application entitled "System and Method for Adaptive Intelligent Noise Suppression," Ser. No. 11/825,563, filed Jul. 6, 2007, which is incorporated by reference.

In exemplary embodiments, the noise estimate is based on the acoustic signal from the primary microphone 106 and the results from the adaptive classifier 406. The exemplary noise estimate module 408 generates a noise estimate which is a component that can be approximated mathematically by $$N(t,\omega)=\lambda_1(t,\omega)E_1(t,\omega)+(1-\lambda_1(t,\omega))\min[N(t-1,\omega),E_1(t,\omega)]$$

according to one embodiment of the present invention. As shown, the noise estimate in this embodiment is based on minimum statistics of a current energy estimate of the primary acoustic signal, $E_1(t,\omega)$ and a noise estimate of a previous time frame, $N(t-1, \omega)$. As a result, the noise estimation is performed efficiently and with low latency.

$\lambda_1(t,\omega)$ in the above equation may be derived from the ILD approximated by the ILD module 404, as $$\lambda_l(t,\omega)=\begin{cases}\approx 0 & \text{if } ILD(t,\omega)<\text{threshold}\\ \approx 1 & \text{if } ILD(t,\omega)>\text{threshold}\end{cases}$$

That is, when the primary microphone 106 is smaller than a threshold value (e.g., threshold=0.5) above which speech is expected to be, $\lambda_1$ is small, and thus the noise estimate module 408 follows the noise closely. When ILD starts to rise (e.g., because speech is present within the large ILD region), $\lambda_1$ increases. As a result, the noise estimate module 408 slows down the noise estimation process and the speech energy does not contribute significantly to the final noise estimate. Alternative embodiments, may contemplate other methods for determining the noise estimate or noise spectrum. The noise spectrum (i.e., noise estimates for all frequency bands of an acoustic signal) may then be forwarded to the AIS generator 410.

The AIS generator 410 receives speech energy of the primary spectrum from the energy module 402. This primary spectrum may also comprise some residual noise after processing by the noise subtraction engine 304. The AIS generator 410 may also receive the noise spectrum from the noise estimate module 408. Based on these inputs and an optional ILD from the ILD module 404, a speech spectrum may be inferred. In one embodiment, the speech spectrum is inferred by subtracting the noise estimates of the noise spectrum from the power estimates of the primary spectrum. Subsequently, the AIS generator 410 may determine gain masks to apply to the primary acoustic signal. More detailed discussion of the AIS generator 410 may be found in U.S. patent application Ser. No. 11/825,563 entitled "System and Method for Adaptive Intelligent Noise Suppression," which is incorporated by reference. In exemplary embodiments, the gain mask output from the AIS generator 410, which is time and frequency dependent, will maximize noise suppression while constraining speech loss distortion.

It should be noted that the system architecture of the noise suppression engine **306*a* is exemplary. Alternative embodiments may comprise more components, less components, or equivalent components and still be within the scope of embodiments of the present invention. Various modules of the noise suppression engine 306*a* may be combined into a single module. For example, the functionalities of the ILD module 404 may be combined with the functions of the energy module 402**.

Figure 5:
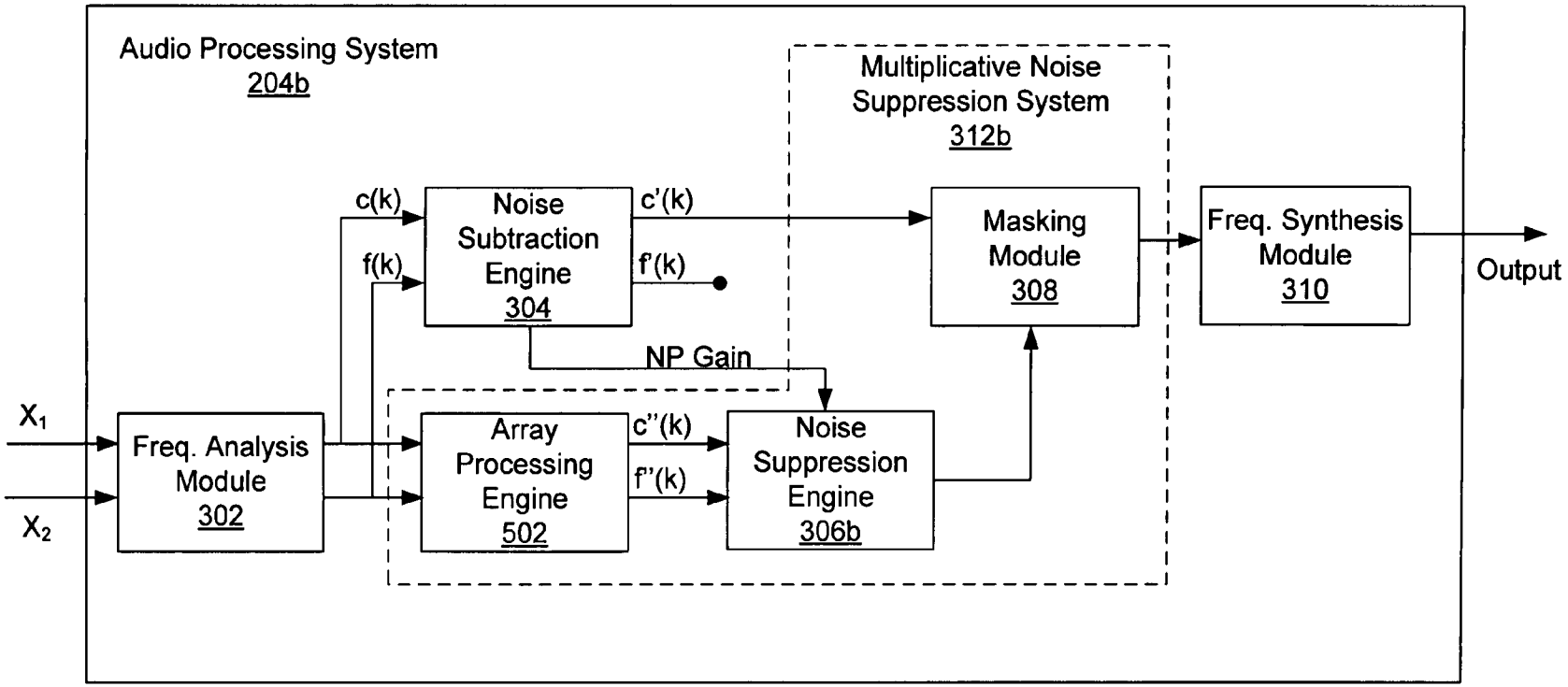
FIG. 5 is a block diagram of an exemplary audio processing system utilizing a close microphone array.

Referring now to FIG. 5, a detailed block diagram of an alternative audio processing system **204*b* is shown. In contrast to the audio processing system 204*a* of FIG. 3, the audio processing system 204*b* of FIG. 5 may be utilized in embodiments comprising a close microphone array. The functions of the frequency analysis module 302, masking module 308, and frequency synthesis module 310 are identical to those described with respect to the audio processing system 204*a* of FIG. 3** and will not be discussed in detail.

The sub-band signals determined by the frequency analysis module 302 may be forwarded to the noise subtraction engine 304 and an array processing engine 502. The exemplary noise subtraction engine 304 is configured to adaptively subtract out a noise component from the primary acoustic signal for each sub-band. As such, output of the noise subtraction engine 304 is a noise subtracted signal comprised of noise subtracted sub-band signals. In the present embodiment, the noise subtraction engine 304 also provides a null processing (NP) gain to the noise suppression engine **306*a*. The NP gain comprises an energy ratio indicating how much of the primary signal has been cancelled out of the noise subtracted signal. If the primary signal is dominated by noise, then NP gain will be large. In contrast, if the primary signal is dominated by speech, NP gain will be close to zero. The noise subtraction engine 304 will be discussed in more detail in connection with FIG. 7*a* and FIG. 7*b*** below.

In exemplary embodiments, the array processing engine 502 is configured to adaptively process the sub-band signals of the primary and secondary signals to create directional patterns (i.e., synthetic directional microphone responses) for the close microphone array (e.g., the primary and secondary microphones 106 and 108). The directional patterns may comprise a forward-facing cardioid pattern based on the primary acoustic (sub-band) signals and a backward-facing cardioid pattern based on the secondary (sub-band) acoustic signal. In one embodiment, the sub-band signals may be adapted such that a null of the backward-facing cardioid pattern is directed towards the audio source 102. More details regarding the implementation and functions of the array processing engine 502 may be found (referred to as the adaptive array processing engine) in U.S. patent application Ser. No. 12/080,115 entitled "System and Method for Providing Close Microphone Array Noise Reduction," which is incorporated by reference. The cardioid signals (i.e., a signal implementing the forward-facing cardioid pattern and a signal implementing the backward-facing cardioid pattern) are then provided to the noise suppression engine **306*b* by the array processing engine 502**.

The noise suppression engine **306*b* receives the NP gain along with the cardioid signals. According to exemplary embodiments, the noise suppression engine 306*b* generates a gain mask to be applied to the noise subtracted sub-band signals from the noise subtraction engine 304 in order to further reduce any noise components that may remain in the noise subtracted speech signal. The noise suppression engine 306*b* will be discussed in more detail in connection with FIG. 6** below.

The gain mask determined by the noise suppression engine **306*b* may then be applied to the noise subtracted signal in the masking module 308. Accordingly, each gain mask may be applied to an associated noise subtracted frequency sub-band to generate masked frequency sub-bands. Subsequently, the masked frequency sub-bands are converted back into time domain from the cochlea domain by the frequency synthesis module 310. Once conversion is completed, the synthesized acoustic signal may be output to the user. As depicted in FIG. 5, a multiplicative noise suppression system 312***b* comprises the array processing engine 502, the noise suppression engine 306*b*, and the masking module 308.

Figure 6:
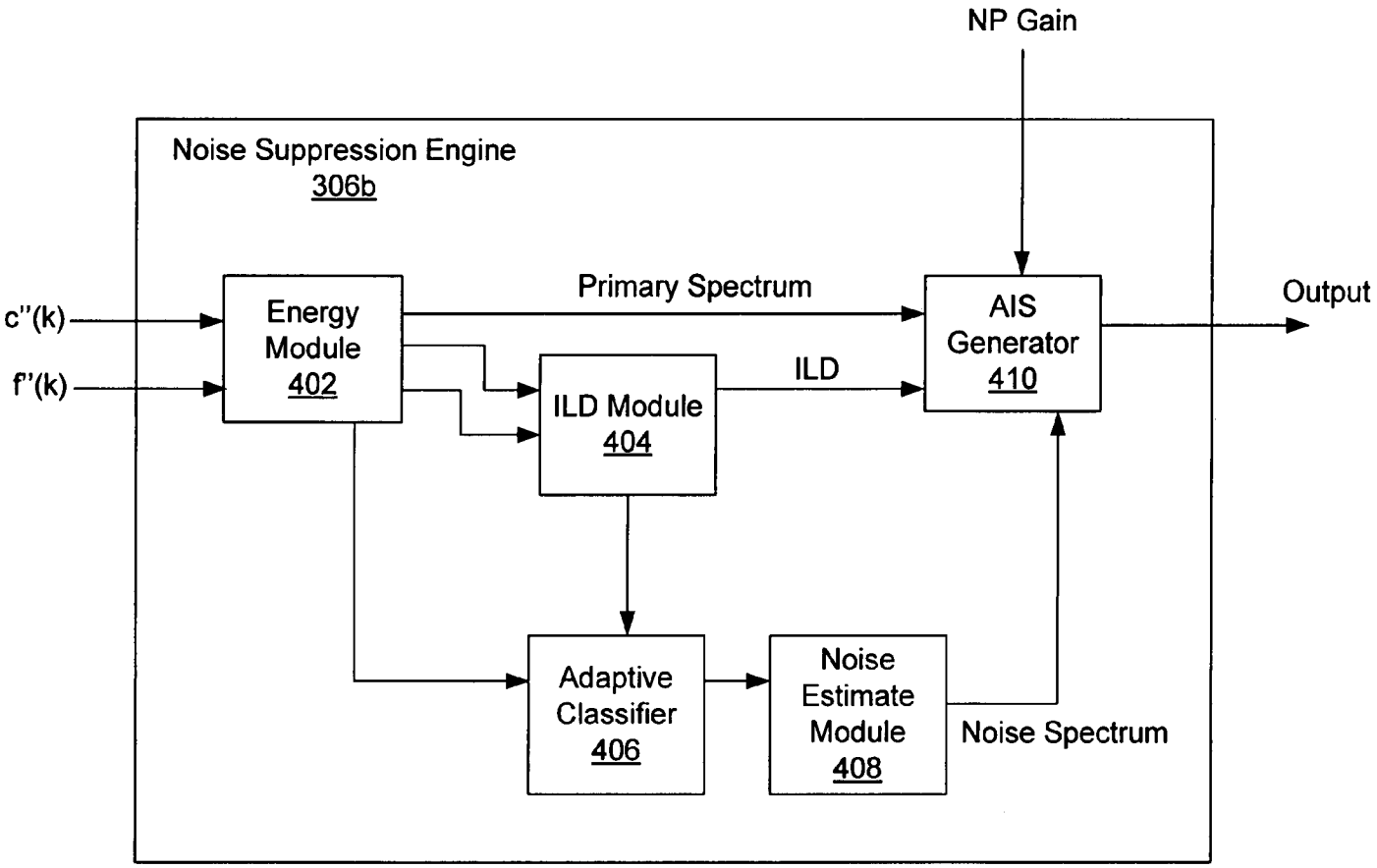
FIG. 6 is a block diagram of an exemplary noise suppression system of the audio processing system of FIG. 5.

Referring now to FIG. 6, the exemplary noise suppression engine 306*b* is shown in more detail. The exemplary noise suppression engine 306*b* comprises the energy module 402, the inter-microphone level difference (ILD) module 404, the adaptive classifier 406, the noise estimate module 408, and the adaptive intelligent suppression (AIS) generator 410. It should be noted that the various modules of the noise suppression engine 306*b* functions similar to the modules in the noise suppression engine 306*a*.

In the present embodiment, the primary acoustic signal (c"(k)) and the secondary acoustic signal (f"(k)) are received by the energy module 402 which computes energy/power estimates during an interval of time for each frequency band (i.e., power estimates) of an acoustic signal. As a result, the primary spectrum (i.e., the power spectral density of the primary sub-band signals) across all frequency bands may be determined by the energy module 402. This primary spectrum may be supplied to the AIS generator 410 and the ILD module 404. Similarly, the energy module 402 determines a secondary spectrum (i.e., the power spectral density of the secondary sub-band signal) across all frequency bands which is also supplied to the ILD module 404. More details regarding the calculation of power estimates and power spectrums can be found in co-pending U.S. patent application Ser. No. 11/343,524 and co-pending U.S. patent application Ser. No. 11/699,732, which are incorporated by reference.

As previously discussed, the power spectrums may be used by the ILD module 404 to determine an energy difference between the primary and secondary microphones 106 and 108. The ILD may then be forwarded to the adaptive classifier 406 and the AIS generator 410. In alternative embodiments, other forms of ILD or energy differences between the primary and secondary microphones 106 and 108 may be utilized. For example, a ratio of the energy of the primary and secondary microphones 106 and 108 may be used. It should also be noted that alternative embodiments may use cues other then ILD for adaptive classification and noise suppression (i.e., gain mask calculation). For example, noise floor thresholds may be used. As such, references to the use of ILD may be construed to be applicable to other cues.

The exemplary adaptive classifier 406 and noise estimate module 408 perform the same functions as that described in accordance with FIG. 4. That is, the adaptive classifier differentiates noise and distractors from speech and provides the results to the noise estimate module 408 which derives the noise estimate.

The AIS generator 410 receives speech energy of the primary spectrum from the energy module 402. The AIS generator 410 may also receive the noise spectrum from the noise estimate module 408. Based on these inputs and an optional ILD from the ILD module 404, a speech spectrum may be inferred. In one embodiment, the speech spectrum is inferred by subtracting the noise estimates of the noise spectrum from the power estimates of the primary spectrum. Additionally, the AIS generator 410 uses the NP gain, which indicates how much noise has already been cancelled by the time the signal reaches the noise suppression engine 306*b* (i.e., the multiplicative mask) to determine gain masks to apply to the primary acoustic signal. In one example, as the NP gain increases, the estimated SNR for the inputs decreases. In exemplary embodiments, the gain mask output from the AIS generator 410, which is time and frequency dependent, may maximize noise suppression while constraining speech loss distortion.

It should be noted that the system architecture of the noise suppression engine 306*b* is exemplary. Alternative embodiments may comprise more components, less components, or equivalent components and still be within the scope of embodiments of the present invention.

Figure 7A:
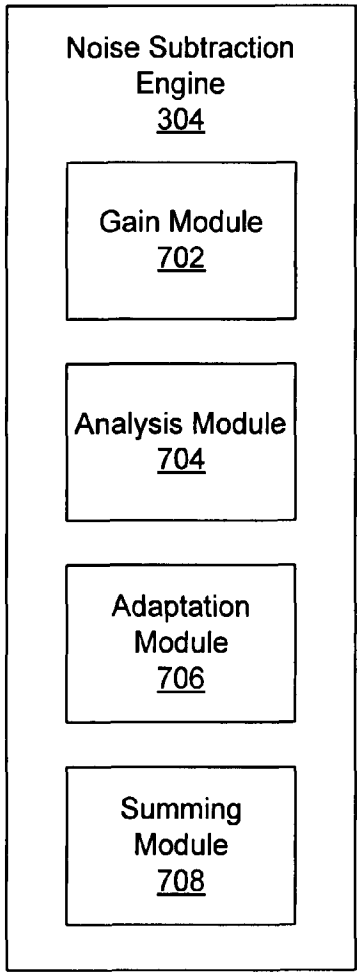
FIG. 7*a* is a block diagram of an exemplary noise subtraction engine.

FIG. 7*a* is a block diagram of an exemplary noise subtraction engine 304. The exemplary noise subtraction engine 304 is configured to suppress noise using a subtractive process. The noise subtraction engine 304 may determine a noise subtracted signal by initially subtracting out a desired component (e.g., the desired speech component) from the primary signal in a first branch, thus resulting in a noise component. Adaptation may then be performed in a second branch to cancel out the noise component from the primary signal. In exemplary embodiments, the noise subtraction engine 304 comprises a gain module 702, an analysis module 704, an adaptation module 706, and at least one summing module 708 configured to perform signal subtraction. The functions of the various modules 702-708 will be discussed in connection with FIG. 7*a* and further illustrated in operation in connection with FIG. 7*b*.

Referring to FIG. 7*a*, the exemplary gain module 702 is configured to determine various gains used by the noise subtraction engine 304. For purposes of the present embodiment, these gains represent energy ratios. In the first branch, a reference energy ratio ($g_1$) of how much of the desired component is removed from the primary signal may be determined. In the second branch, a prediction energy ratio ($g_2$) of how much the energy has been reduced at the output of the noise subtraction engine 304 from the result of the first branch may be determined. Additionally, an energy ratio (i.e., NP gain) may be determined that represents the energy ratio indicating how much noise has been canceled from the primary signal by the noise subtraction engine 304. As previously discussed, NP gain may be used by the AIS generator 410 in the close microphone embodiment to adjust the gain mask.

The exemplary analysis module 704 is configured to perform the analysis in the first branch of the noise subtraction engine 304, while the exemplary adaptation module 706 is configured to perform the adaptation in the second branch of the noise subtraction engine 304.

Referring to FIG. 7*b*, a schematic illustrating the operations of the noise subtraction engine 304 is shown. Sub-band signals of the primary microphone signal c(k) and secondary microphone signal f(k) are received by the noise subtraction engine 304 where k represents a discrete time or sample index. c(k) represents a superposition of a speech signal s(k) and a noise signal n(k). f(k) is modeled as a superposition of the speech signal s(k), scaled by a complex-valued coefficient $\sigma$, and the noise signal n(k), scaled by a complex-valued coefficient $\nu$. $\nu$ represents how much of the noise in the primary signal is in the secondary signal. In exemplary embodiments, $\nu$ is unknown since a source of the noise may be dynamic.

In exemplary embodiments, $\sigma$ is a fixed coefficient that represents a location of the speech (e.g., an audio source location). In accordance with exemplary embodiments, $\sigma$ may be determined through calibration. Tolerances may be included in the calibration by calibrating based on more than one position. For a close microphone, a magnitude of a may be close to one. For spread microphones, the magnitude of $\sigma$ may be dependent on where the audio device 102 is positioned relative to the speaker's mouth. The magnitude and phase of the $\sigma$ may represent an inter-channel cross-spectrum for a speaker's mouth position at a frequency represented by the respective sub-band (e.g., Cochlea tap). Because the noise subtraction engine 304 may have knowledge of what $\sigma$ is, the analysis module 704 may apply $\sigma$ to the primary signal (i.e., $\sigma(s(k)+n(k))$ and subtract the result from the secondary signal (i.e., $\sigma s(k)+\nu(k)$) in order to cancel out the speech component $\sigma s(k)$ (i.e., the desired component) from the secondary signal resulting in a noise component out of the summing module 708. In an embodiment where there is not speech, $\alpha$ is approximately $1/(\nu-\sigma)$, and the adaptation module 706 may freely adapt.

If the speaker's mouth position is adequately represented by $\sigma$, then $f(k)-\sigma c(k)=(\nu-\sigma)n(k)$. This equation indicates that signal at the output of the summing module 708 being fed into the adaptation module 706 (which, in turn, applies an adaptation coefficient $\alpha(k)$) may be devoid of a signal originating from a position represented by $\sigma$ (e.g., the desired speech signal). In exemplary embodiments, the analysis module 704 applies $\sigma$ to the secondary signal f(k) and subtracts the result from c(k). Remaining signal (referred to herein as "noise component signal") from the summing module 708 may be canceled out in the second branch.

The adaptation module 706 may adapt when the primary signal is dominated by audio sources 102 not in the speech location (represented by $\sigma$). If the primary signal is dominated by a signal originating from the speech location as represented by $\sigma$, adaptation may be frozen. In exemplary embodiments, the adaptation module 706 may adapt using one of a common least-squares method in order to cancel the noise component n(k) from the signal c(k). The coefficient may be update at a frame rate according to on embodiment.

In an embodiment where n(k) is white and a cross-correlation between s(k) and n(k) is zero within a frame, adaptation may happen every frame with the noise n(k) being perfectly cancelled and the speech s(k) being perfectly unaffected. However, it is unlikely that these conditions may be met in reality, especially if the frame size is short. As such, it is desirable to apply constraints on adaptation. In exemplary embodiments, the adaptation coefficient $\alpha(k)$ may be updated on a per-tap/per-frame basis when the reference energy ratio $g_1$ and the prediction energy ratio $g_2$ satisfy the follow condition:

$$g_2\cdot\gamma>g_1/\gamma$$

where $\gamma>0$. Assuming, for example, that $\hat{\sigma}(k)=\sigma$, $\alpha(k)=1/(\nu-\sigma)$, and s(k) and n(k) are uncorrelated, the following may be obtained:

$$g_1=\frac{E\{(s(k)+n(k))^2\}}{|\nu-\sigma|^2\cdot E\{n^2(k)\}}=\frac{S+N}{|\nu-\sigma|^2\cdot N}\text{ and}$$

$$g_2=\frac{|\nu-\sigma|^2\cdot E\{n^2(k)\}}{E\{s^2(k)\}}=|\nu-\sigma|^2\cdot\frac{N}{S},$$

where E{ . . . } is an expected value, S is a signal energy, and N is a noise energy. From the previous three equations, the following may be obtained:

$$SNR^2+SNR<\gamma^2|\nu-\sigma|^4,$$

where SNR=S/N. If the noise is in the same location as the target speech (i.e., $\sigma=\nu$), this condition may not be met, so regardless of the SNR, adaptation may never happen. The further away from the target location the source is, the greater $|\nu-\sigma|^4$ and the larger the SNR is allowed to be while there is still adaptation attempting to cancel the noise.

In exemplary embodiments, adaptation may occur in frames where more signal is canceled in the second branch as opposed to the first branch. Thus, energies may be calculated after the first branch by the gain module 702 and $g_1$ determined. An energy calculation may also be performed in order to determine $g_2$ which may indicate if $\alpha$ is allowed to adapt. If $\gamma^2|\nu-\sigma|^4>SNR^2+SNR^4$ is true, then adaptation of a may be performed. However, if this equation is not true, then $\alpha$ is not adapted.

The coefficient $\gamma$ may be chosen to define a boundary between adaptation and non-adaptation of $\alpha$. In an embodiment where a far-field source at 90 degree angle relative to a straight line between the microphones 106 and 108. In this embodiment, the signal may have equal power and zero phase shift between both microphones 106 and 108 (e.g., $\nu=1$). If the SNR=1, then $\gamma^2|\nu-\sigma|^4=2$, which is equivalent to $\gamma=\text{sqrt}(2)/|1-\sigma|^4$.

Lowering $\gamma$ relative to this value may improve protection of the near-end source from cancellation at the expense of increased noise leakage; raising $\gamma$ has an opposite effect. It should be noted that in the microphones 106 and 108, $\nu=1$ may not be a good enough approximation of the far-field/90 degrees situation and may have to substituted by a value obtained from calibration measurements.

Figure 8:
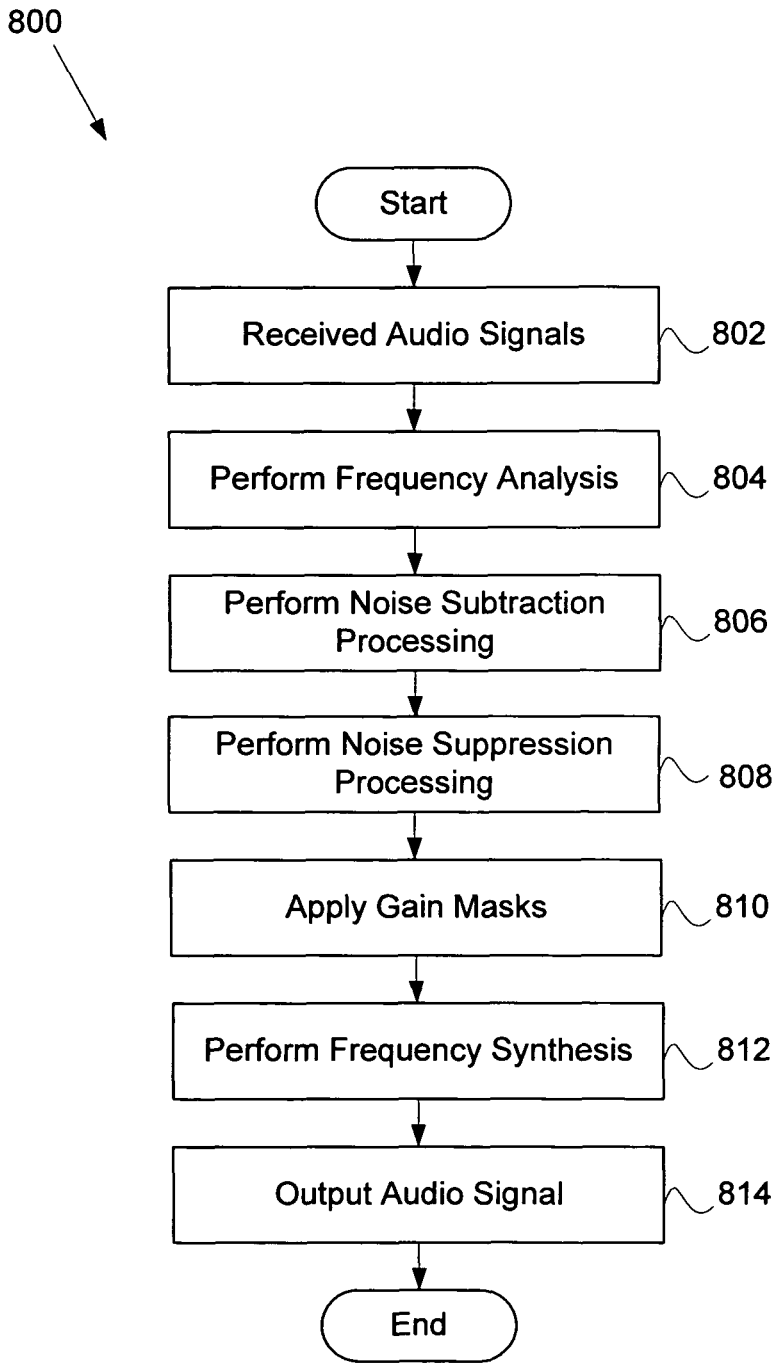
FIG. 8 is a flowchart of an exemplary method for suppressing noise in an audio device.

FIG. 8 is a flowchart 800 of an exemplary method for suppressing noise in an audio device. In step 802, audio signals are received by the audio device 102. In exemplary embodiments, a plurality of microphones (e.g., primary and secondary microphones 106 and 108) receive the audio signals. The plurality of microphones may comprise a close microphone array or a spread microphone array.

In step 804, the frequency analysis on the primary and secondary acoustic signals may be performed. In one embodiment, the frequency analysis module 302 utilizes a filter bank to determine frequency sub-bands for the primary and secondary acoustic signals.

Noise subtraction processing is performed in step 806. Step 806 will be discussed in more detail in connection with FIG. 9 below.

Noise suppression processing may then be performed in step 808. In one embodiment, the noise suppression processing may first compute an energy spectrum for the primary or noise subtracted signal and the secondary signal. An energy difference between the two signals may then be determined. Subsequently, the speech and noise components may be adaptively classified according to one embodiment. A noise spectrum may then be determined. In one embodiment, the noise estimate may be based on the noise component. Based on the noise estimate, a gain mask may be adaptively determined.

The gain mask may then be applied in step 810. In one embodiment, the gain mask may be applied by the masking module 308 on a per sub-band signal basis. In some embodiments, the gain mask may be applied to the noise subtracted signal. The sub-bands signals may then be synthesized in step 812 to generate the output. In one embodiment, the sub-band signals may be converted back to the time domain from the frequency domain. Once converted, the audio signal may be output to the user in step 814. The output may be via a speaker, earpiece, or other similar devices.

Figure 9:
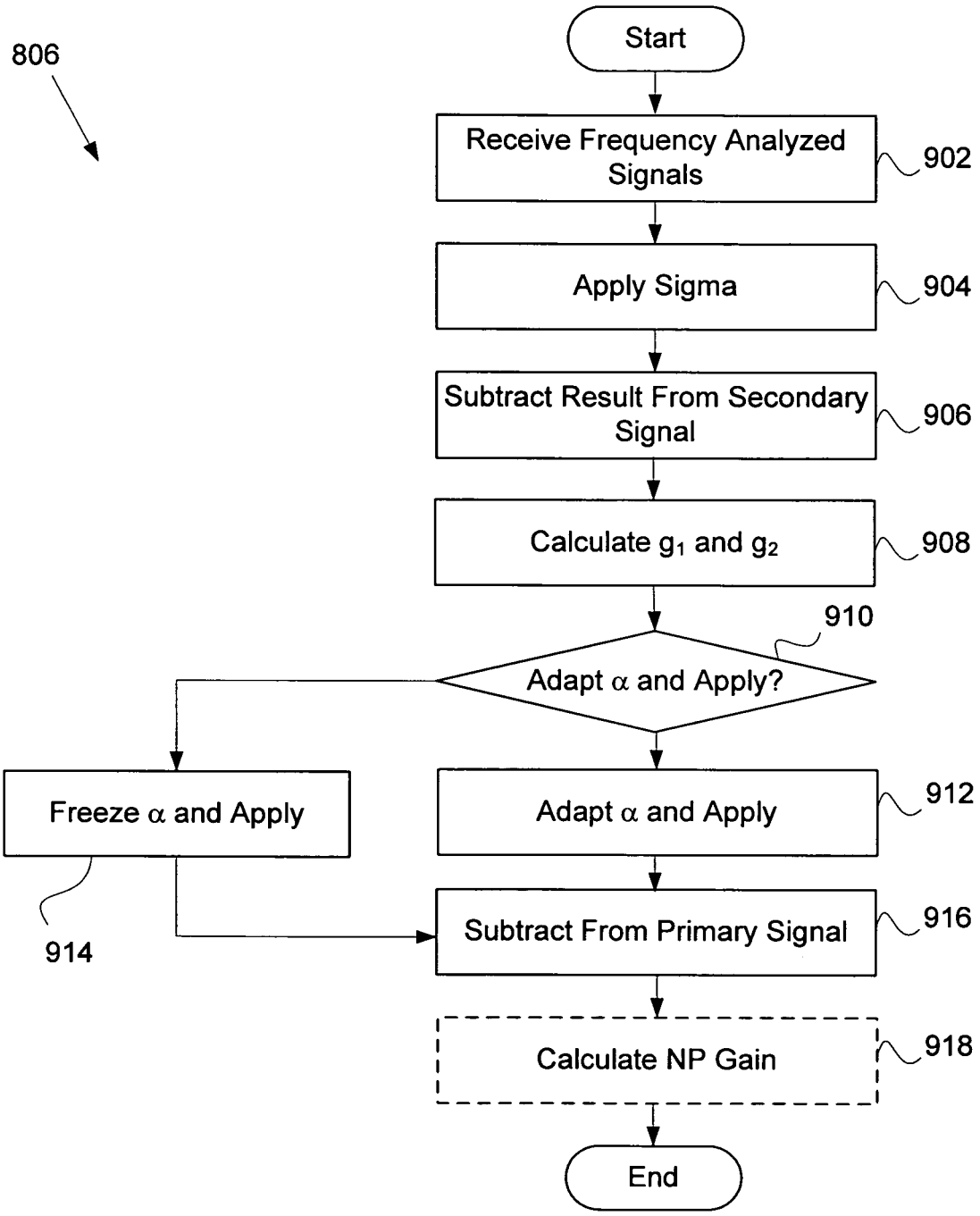
FIG. 9 is a flowchart of an exemplary method for performing noise subtraction processing.

Referring now to FIG. 9, a flowchart of an exemplary method for performing noise subtraction processing (step 806) is shown. In step 902, the frequency analyzed signals (e.g., frequency sub-band signals or primary signal) are received by the noise subtraction engine 304. The primary acoustic signal may be represented as c(k)=s(k)+n(k) where s(k) represents the desired signal (e.g., speech signal) and n(k) represents the noise signal. The secondary frequency analyzed signal (e.g., secondary signal) may be represented as $f(k)=\sigma s(k)+\nu n(k)$.

In step 904, $\sigma$ may be applied to the primary signal by the analysis module 704. The result of the application of $\sigma$ to the primary signal may then be subtracted from the secondary signal in step 906 by the summing module 708. The result comprises a noise component signal.

In step 908, the gains may be calculated by the gain module 702. These gains represent energy ratios of the various signals. In the first branch, a reference energy ratio ($g_1$) of how much of the desired component is removed from the primary signal may be determined. In the second branch, a prediction energy ratio ($g_2$) of how much the energy has been reduce at the output of the noise subtraction engine 304 from the result of the first branch may be determined.

In step 910, a determination is made as to whether $\alpha$ should be adapted. In accordance with one embodiment if $SNR^2+SNR<\gamma^2|\nu-\sigma|^4$ is true, then adaptation of $\alpha$ may be performed in step 912. However, if this equation is not true, then $\alpha$ is not adapted but frozen in step 914.

The noise component signal, whether adapted or not, is subtracted from the primary signal in step 916 by the summing module 708. The result is a noise subtracted signal. In some embodiments, the noise subtracted signal may be provided to the noise suppression engine 306 for further noise suppression processing via a multiplicative noise suppression process. In other embodiments, the noise subtracted signal may be output to the user without further noise suppression processing. It should be noted that more than one summing module 708 may be provided (e.g., one for each branch of the noise subtraction engine 304).

In step 918, the NP gain may be calculated. The NP gain comprises an energy ratio indicating how much of the primary signal has been cancelled out of the noise subtracted signal. It should be noted that step 918 may be optional (e.g., in close microphone systems).

The above-described modules may be comprised of instructions that are stored in storage media such as a machine readable medium (e.g., a computer readable medium). The instructions may be retrieved and executed by the processor 202. Some examples of instructions include software, program code, and firmware. Some examples of storage media comprise memory devices and integrated circuits. The instructions are operational when executed by the processor 202 to direct the processor 202 to operate in accordance with embodiments of the present invention. Those skilled in the art are familiar with instructions, processors, and storage media.

The present invention is described above with reference to exemplary embodiments. It will be apparent to those skilled in the art that various modifications may be made and other embodiments may be used without departing from the broader scope of the present invention. For example, the microphone array discussed herein comprises a primary and secondary microphone 106 and 108. However, alternative embodiments may contemplate utilizing more microphones in the microphone array. Therefore, there and other variations upon the exemplary embodiments are intended to be covered by the present invention.

What is claimed is:

1. A method for suppressing noise, comprising:

receiving at least a primary acoustic signal from a primary microphone and a secondary acoustic signal from a different, secondary microphone;

applying a coefficient to the primary acoustic signal to generate a desired signal component, the coefficient representing a source location, the desired signal component not being a function of the secondary acoustic signal;

subtracting the desired signal component from the secondary acoustic signal to obtain a noise component signal;

performing a first determination of at least one energy ratio related to the desired signal component and the noise component signal;

performing a second determination of whether to adjust the noise component signal based on the at least one energy ratio;

adjusting the noise component signal based on the second determination;

subtracting the adjusted noise component signal from the primary acoustic signal to generate a noise subtracted signal; and outputting the noise subtracted signal.

2. The method of claim 1 wherein the at least one energy ratio comprises a reference energy ratio and a prediction energy ratio.

3. The method of claim 2 further comprising adapting an adaptation coefficient applied to the noise component signal when the prediction energy ratio is greater than the reference energy ratio.

4. The method of claim 2 further comprising freezing an adaptation coefficient applied to the noise component signal when the prediction energy ratio is less than the reference energy ratio.

5. The method of claim 1 further comprising determining a NP gain based on the at least one energy ratio, the NP gain indicating how much of the primary acoustic signal has been cancelled out of the noise subtracted signal.

6. The method of claim 5 further comprising providing the NP gain to a multiplicative noise suppression system.

7. The method of claim 1 wherein the primary and secondary acoustic signals are separated into sub-band signals.

8. The method of claim 1 wherein outputting the noise subtracted signal comprises outputting the noise subtracted signal to a multiplicative noise suppression system.

9. The method of claim 8 wherein the multiplicative noise suppression system comprises generating a gain mask based at least on the noise subtracted signal.

10. The method of claim 9 further comprising applying the gain mask to the noise subtracted signal to generate an audio output signal.

11. A system for suppressing noise, comprising:

a microphone array configured to receive at least a primary acoustic signal from a primary microphone and a secondary acoustic signal from a different, secondary microphone;

an analysis module configured to generate a desired signal component which may be subtracted from the secondary acoustic signal to obtain a noise component signal, the analysis module being further configured to apply a coefficient to the primary acoustic signal to generate the desired signal component, the coefficient representing a source location, the desired signal component not being a function of the secondary acoustic signal;

a gain module configured to perform a first determination of at least one energy ratio related to the desired signal component and the noise component signal;

an adaptation module configured to perform a second determination of whether to adjust the noise component signal based on the at least one energy ratio, the adaption module further configured to adjust the noise component signal based on the second determination; and at least one summing module configured to subtract the desired signal component from the adjusted secondary acoustic signal and to subtract the noise component signal from the primary acoustic signal to generate a noise subtracted signal.

12. The system of claim 11 wherein the at least one energy ratio comprises a reference energy ratio and a prediction energy ratio.

13. The system of claim 12 wherein the adaptation module is configured to adapt an adaptation coefficient applied to the noise component signal when the prediction energy ratio is greater than the reference energy ratio.

14. The system of claim 12 wherein the adaptation module is configured to freeze an adaptation coefficient applied to the noise component signal when the prediction energy ratio is less than the reference energy ratio.

15. The system of claim 11 wherein further comprising a gain module configured to determine a NP gain based on the at least one energy ratio, the NP gain indicating how much of the primary acoustic signal has been cancelled out of the noise subtracted signal.

16. A non-transitory machine readable storage medium having embodied thereon a program, the program providing instructions executable by a processor for suppressing noise using noise subtraction processing method, the method comprising:

receiving at least a primary acoustic signal from a primary microphone and a secondary acoustic signal from a different, secondary microphone;

applying a coefficient to the primary acoustic signal to generate a desired signal component, the coefficient representing a source location, the desired signal component not being a function of the secondary acoustic signal;

subtracting the desired signal component from the secondary acoustic signal to obtain a noise component signal;

performing a first determination of at least one energy ratio related to the desired signal component and the noise component signal;

performing a second determination of whether to adjust the noise component signal based on the at least one energy ratio;

adjusting the noise component signal based on the second determination;

subtracting the adjusted noise component signal from the primary acoustic signal to generate a noise subtracted signal; and outputting the noise subtracted signal.

17. The non-transitory machine readable storage medium of claim 16 wherein the at least one energy ratio comprises a reference energy ratio and a prediction energy ratio.

18. The non-transitory machine readable storage medium of claim 17 wherein the method further comprises adapting an adaptation coefficient applied to the noise component signal when the prediction energy ratio is greater than the reference energy ratio.

19. The non-transitory machine readable storage medium of claim 17 wherein the method further comprises freezing an adaptation coefficient applied to the noise component signal when the prediction energy ratio is less than the reference energy ratio.

20. A method for suppressing noise, comprising:

receiving at least a primary acoustic signal from a primary microphone and a secondary acoustic signal from a different, secondary microphone;

applying a coefficient to the primary acoustic signal to generate a desired signal component, the coefficient representing a source location, the desired signal component not being a function of the secondary acoustic signal;

subtracting the desired signal component from the secondary acoustic signal to obtain a noise component signal;

performing a first determination of at least one energy ratio related to the desired signal component and the noise component signal, wherein the at least one energy ratio comprises a reference energy ratio and a prediction energy ratio;

performing a second determination of whether to adjust the noise component signal based on the at least one energy ratio;

adjusting the noise component signal based on the second determination; and subtracting adjusted the noise component signal from the primary acoustic signal to generate a noise subtracted signal.

* * * * *